US005663741A

United States Patent [19]

Kanazawa

[11] Patent Number: 5,663,741

[45] Date of Patent: Sep. 2, 1997

[54] CONTROLLER OF PLASMA DISPLAY PANEL AND METHOD OF CONTROLLING THE SAME

[75] Inventor: Yoshikazu Kanazawa, Kawasaki, Japan

[73] Assignee: Fujitsu Limited, Kawasaki, Japan

[21] Appl. No.: 618,270

[22] Filed: Mar. 18, 1996

Related U.S. Application Data

[63] Continuation of Ser. No. 186,850, Jan. 27, 1944, abandoned.

[30] Foreign Application Priority Data

Apr. 30, 1993 [JP] Japan ..... 5-104087

[51] Int. Cl.[6] ..... G09G 3/28

[52] U.S. Cl. ..... 345/66; 345/67

[58] Field of Search ..... 345/60–63, 66–71, 345/204, 208–210, 214; 315/169.4; 313/581, 585

[56] References Cited

U.S. PATENT DOCUMENTS

| | | | |
|---|---|---|---|
| 3,906,451 | 9/1975 | Strom | 345/66 |
| 3,925,703 | 12/1975 | Schermerhorn | 345/67 |
| 4,140,945 | 2/1979 | Trogdon | 345/68 |
| 4,368,465 | 1/1983 | Hirakawa et al. | 345/68 |
| 4,554,537 | 11/1985 | Dick | 345/67 |
| 4,611,203 | 9/1986 | Criscimagna et al. | 345/66 |
| 4,728,864 | 3/1988 | Dick | 345/67 |
| 4,833,463 | 5/1989 | Dick et al. | 345/67 |
| 5,250,936 | 10/1993 | Warren et al. | 345/68 |

FOREIGN PATENT DOCUMENTS 4-315196 11/1992 Japan .

*Primary Examiner*—Steven Saras
*Attorney, Agent, or Firm*—Staas & Halsey

[57] ABSTRACT

A controller for a plasma display having a first drive unit to apply voltage to a sustain electrode of a display unit having a memory function and a second drive unit to apply voltage to an address electrode of the display unit. The first drive unit has a discharge control unit to control the discharge wave form of the voltage applied to the sustain electrode of the display unit. The discharge control unit has a delay element and a switching element connected in series between sustain electrodes. Alternatively, the control unit has a delay element and a switching element connected in series between the sustain electrodes and a constant voltage discrimination element connected in parallel with the delay element.

13 Claims, 16 Drawing Sheets

FIG. 9
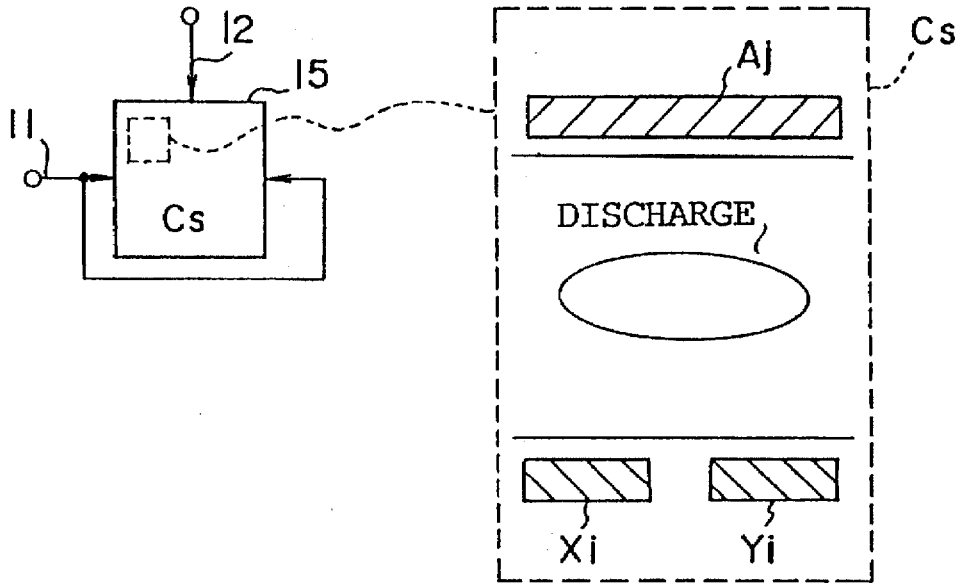
FIG. 10A Aj
FIG. 10B Xi
FIG. 10C Yi
FIG. 10D Yi
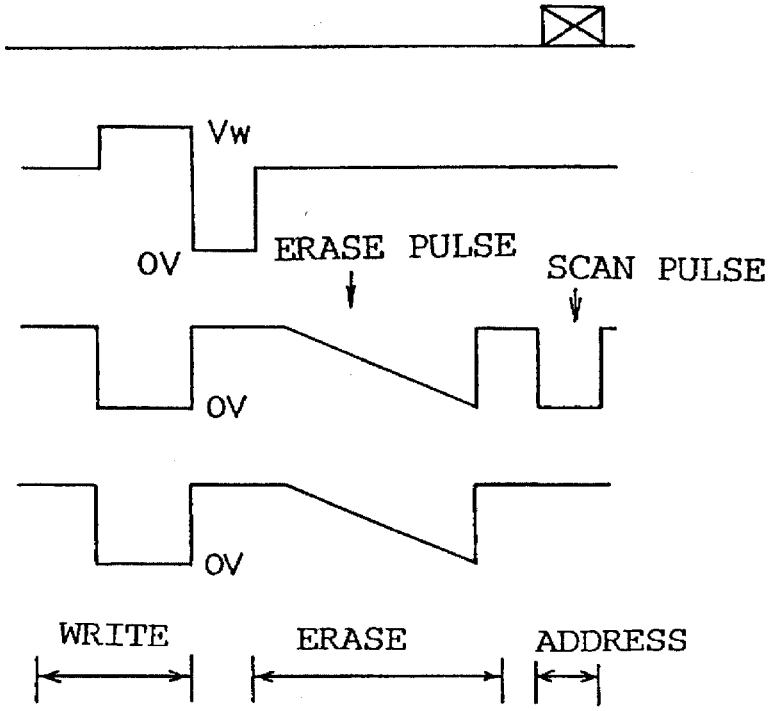

FIG. 13
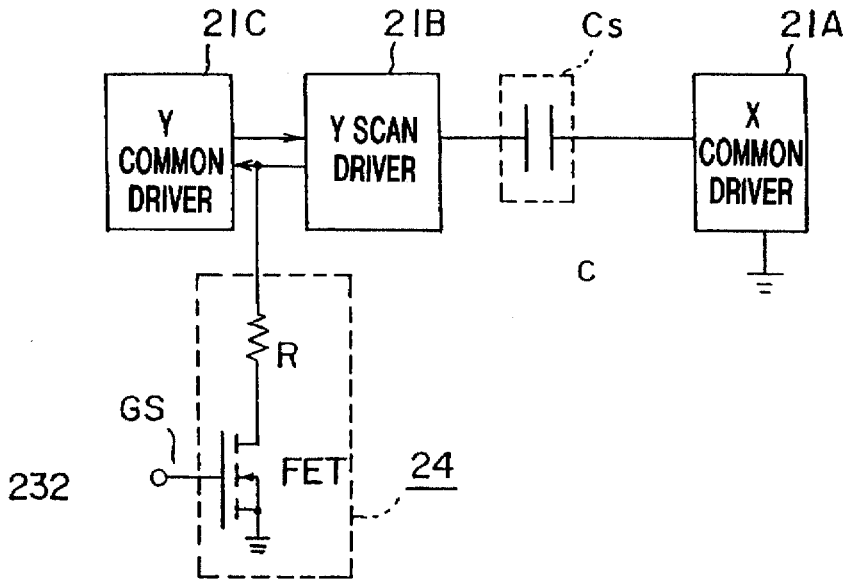
FIG. 14A
FIG. 14B
FIG. 14C
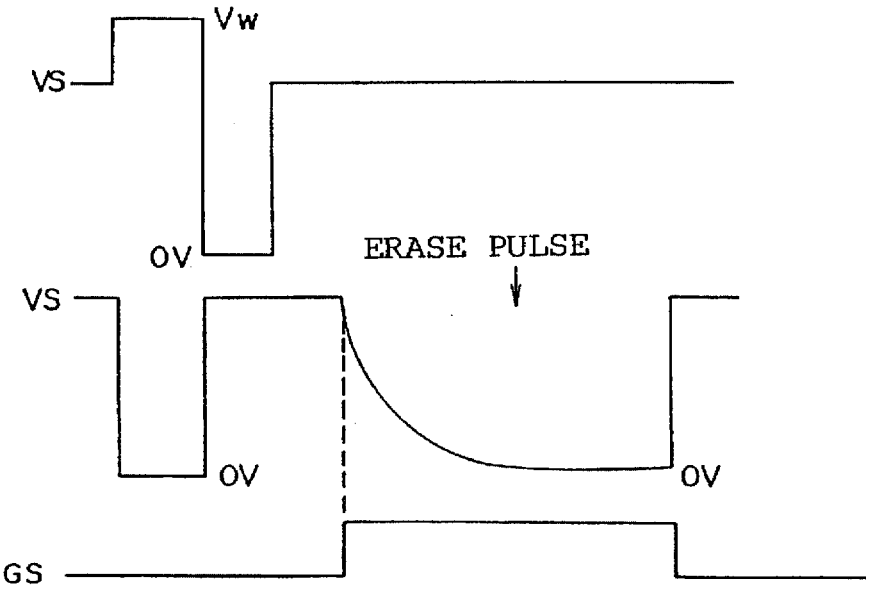

FIG. 20A
FIG. 20B
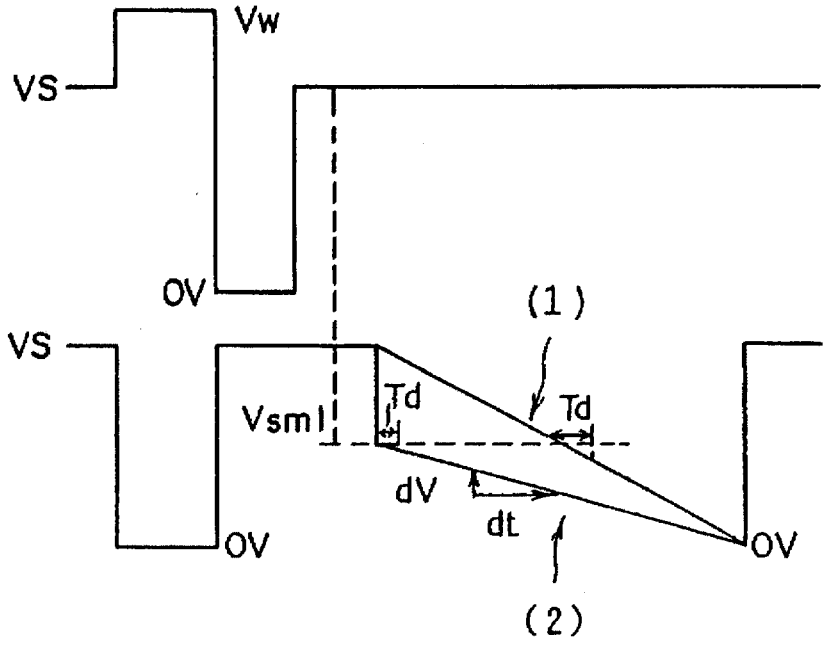
FIG. 21
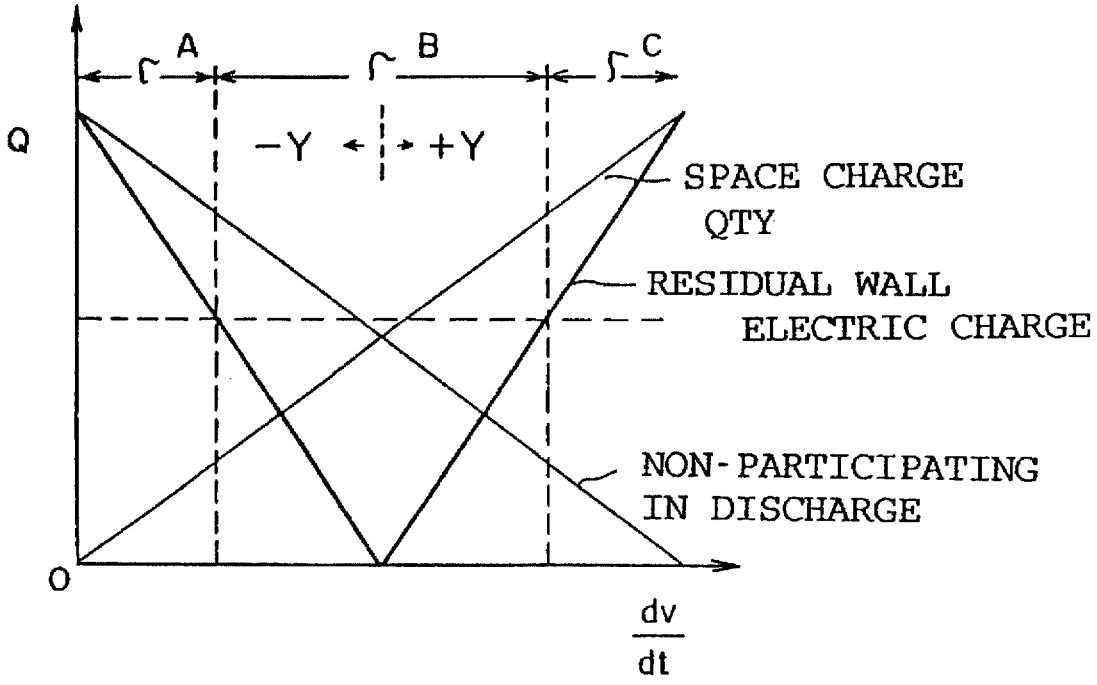

CONTROLLER OF PLASMA DISPLAY PANEL AND METHOD OF CONTROLLING THE SAME

This application is a continuation of application Ser. No. 08/186,850, filed Jan. 27, 1994, now abandoned.

BACKGROUND OF THE INVENTION

1. Field of the Invention

The present invention relates to improvements of a controller of an alternating current (AC) type plasma display panel (PDP) having a memory function and a method of write/erasing thereof.

2. Description of the Related Art

A tendency to use a plane type display unit such as a liquid crystal display and a PDP having a small depth in place of a deep cold cathode ray tube (CRT) has been developed in recent years by the requirement of forming electronic equipment compact in size. For example, an AC type PDP is developed, and improvement of resolution and display quality are aimed at. The AC type PDP has a structure in which display cells each having a memory function are assembled.

According to the AC type PDP, a write address method is adopted in which a wide erasing pulse or a narrow erasing pulse is applied to a sustain electrode to complete a write operation in order to leave wall electric charges acting effectively on the address discharge of the AC type PDP. Address discharge is performed thereafter. When there is dispersion in the discharge starting voltage in each display cell, however, it is impossible to perform an erasing operation accurately, and the display quality is deteriorated.

Here, the related art of the present invention will be described according to FIGS. 1 through 5B. For example, a controller for controlling a PDP 25 of a three-electrode surface discharge type is provided with an X driver 1, a Y scan driver 2, a Y driver 3, an address driver 4 and a control circuit 5 as shown in FIG. 1. Besides, the PDP 25 has N lines×M rows×3 (R,G,B) pieces of display cells Cs each having a memory function.

The display cell Cs of one bit is provided with sustain electrodes (hereinafter referred to simply as an X electrode and a Y electrode) 6 and 7 (see FIG. 2) provided in the same plane, an address electrode 8 provided at a position opposing thereto, a protective film 9 for protecting the X electrode 6 and the Y electrode 7, and a phosphor 10 for coating the address electrode 8 and displaying in color.

As to the function of the controller concerned, a predetermined voltage Vx is supplied to the X electrode 6 from the X driver 1, and predetermined voltage Vy is supplied to the Y driver 3. With this, the Y electrode 7 is scanned by the Y scan driver 2, and the predetermined voltage Vy is supplied to the Y electrode 7. On the other hand, when address data are supplied to the address driver 4 from the control circuit 5, the display cell Cs is selected and luminance display is made.

Namely, in the PDP 25, a predetermined voltage waveform (hereinafter referred to as a sustain pulse) is applied alternately to two pieces of X and Y electrodes 6 and 7, thereby to sustain discharge and make a luminance display. Here, discharge is terminated within 1 μs to several μs immediately after the pulse is applied. Further, negative voltage is applied to positive electric charges (ions) generated by the discharge and which are accumulated on the surface of the protective film (insulating layer) 9 on the X electrode 6, for instance, where negative voltage is applied.

Similarly, negative electric charges (electrons) are accumulated on the surface of the phosphor 10 (insulating layer) on the Y electrode 7 applied with positive voltage.

Therefore, discharge is generated between the electrodes 6 and 7 by supplying a write voltage (hereinafter referred to also as a write pulse) having a high voltage value at the beginning between the X and Y electrodes 6 and 7, thus forming wall electric charges. Thereafter, when a sustain voltage having a different polarity is applied between the X and Y electrodes 6 and 7 at a lower value than the last occasion, the wall electric charges accumulated previously are overlapped onto the sustain voltage.

With this, the relative voltage to the discharge space of the display cell Cs becomes higher and exceeds a discharge threshold value and the display cell Cs starts to discharge. In other words, the display cell Cs, in which write discharge is carried out first and the wall electric charges are generated, has such a feature that discharge is sustained by applying a sustain pulse of a reverse polarity alternately thereafter.

In general, such a state is called a memory effect or a memory function, and display is made by utilizing such a memory effect in the AC type PDP 25.

SUMMARY OF THE INVENTION

It is an object of the present invention to control a discharge waveform of a sustain electrode and have wall electric charges, effective for address discharge, remain behind so as to perform an erasing operation surely even when dispersion of a discharge starting voltage is produced in each display cell.

It is another object of the present invention to control a discharge waveform of an erasing pulse efficiently and, moreover, to provide control very finely with a simple circuit, thereby to perform address discharge at low voltage.

Namely, a controller of plasma display according to the present invention as a preferred embodiment shown in FIG. 6, includes a first driver for applying a pulse voltage between a first electrode and a second electrode of a display cell having three electrodes, a regulation circuit for regulating a quantity of electric charges accumulated by application of the pulse voltage, and a second driver for selecting an individual display cell by applying an address voltage to a third electrode of the display cell.

The regulation circuit includes a delay element for determining a time constant at the time of discharge of the electric charges and a switching element for controlling discharge timing of the electric charges.

The delay element and the switching element are connected in series with each other, and the delay element and the switching element connected in series with each other are connected between the first electrode and the second electrode of the display cell.

A constant voltage discrimination element is provided in the regulation circuit, and the constant voltage discrimination element is connected in parallel with the delay element and regulates a discharge current applied to the delay element.

According to a method of controlling plasma display according to the present invention, the following steps are performed: applying a pulse voltage for sustaining discharge between the first and the second electrodes of the display cells of a plasma display panel, regulating electric charges accumulated between the first and third electrodes or between the second and the third electrodes applied with the pulse voltage, and applying an address voltage for selecting an individual display cell between the first and the third electrodes or between the second and the third electrodes where the electric charges are regulated.

The pulse voltage for sustaining discharge applied between the first and the second electrodes of all of the display cells is a pulse having a polarity the same as that of the address voltage for selecting the individual display cell and is made to rise up to a value which does not exceed the maximum sustain voltage of the display cell during several microseconds to several hundred microseconds.

By adopting such a structure and a method, it becomes possible to provide a controller of a plasma display panel which is of a low power consumption type and capable of high integration, and aims at achieving high quality and high picture quality of the plasma display.

BRIEF DESCRIPTION OF THE DRAWINGS

FIG. 9 is a block diagram of a display cell of one bit for explaining a control method in principle according to the present invention;

FIGS. 10A through 10D show operation waveform diagrams for explaining a control method of the display cell of one bit shown in FIG. 9;

FIG. 13 is a block diagram of a control circuit according to a first preferred embodiment of the present invention;

FIGS. 14A through 14C show operation waveform diagrams of a waveform shaping portion of the control circuit shown in FIG. 13;

FIG. 16A shows a cross-section for explaining a discharge state at a time of a complete write operation of the display cell shown in FIG. 12A. FIG. 16B shows a cross-section for explaining a state of sustaining discharge of the display cell shown in FIG. 16A. FIG. 16C shows a cross-section for explaining the erasing operation of the display cell shown in FIG. 16B. FIG. 16D shows a cross-section for, explaining a discharge state at a time of selective write (address discharge) of the display cell shown in FIG. 16C;

FIGS. 20A and 20B show enlarged waveform diagrams at a time of an erasing operation for comparing a waveform according to the first embodiment of the present invention with a waveform according to the second embodiment of the present invention;

FIG. 21 is a graph for explaining gradient versus electric charge quantity of an erasing pulse of the enlarged waveform at a time of the erasing operation shown in FIG. 20;

FIG. 23A shows a cross-section for explaining a discharge state at a time of a complete write operation of the display cell shown in FIG. 12A. FIG. 23B shows a cross-section for explaining the erasing operation of the display cell shown in FIG. 23A. FIG. 23C shows a cross-section for explaining a discharge state at a time of selective write (address discharge) of the display cell shown in FIG. 23B.

DESCRIPTION OF THE PREFERRED EMBODIMENTS

Now, according to a method of controlling a plasma display panel according to the related art of the present invention, a write address method is adopted in which a wide erasing pulse (solid line) or a narrow erasing pulse (dotted line) shown in FIGS. 3A through 3D are applied between X and Y electrodes 6 and 7 following the complete write operation of a PDP 25 in order to leave wall electric charges acting effectively on address discharge, and address discharge is performed thereafter.

This is due to the reason that, when the residual wall electric charge quantity is constant in each display cell CS, the address voltage also becomes almost constant, and the operation voltage margins of all of the display cells Cs coincide with one another, and it becomes possible to secure stabilized operation as a result.

Figure 1:
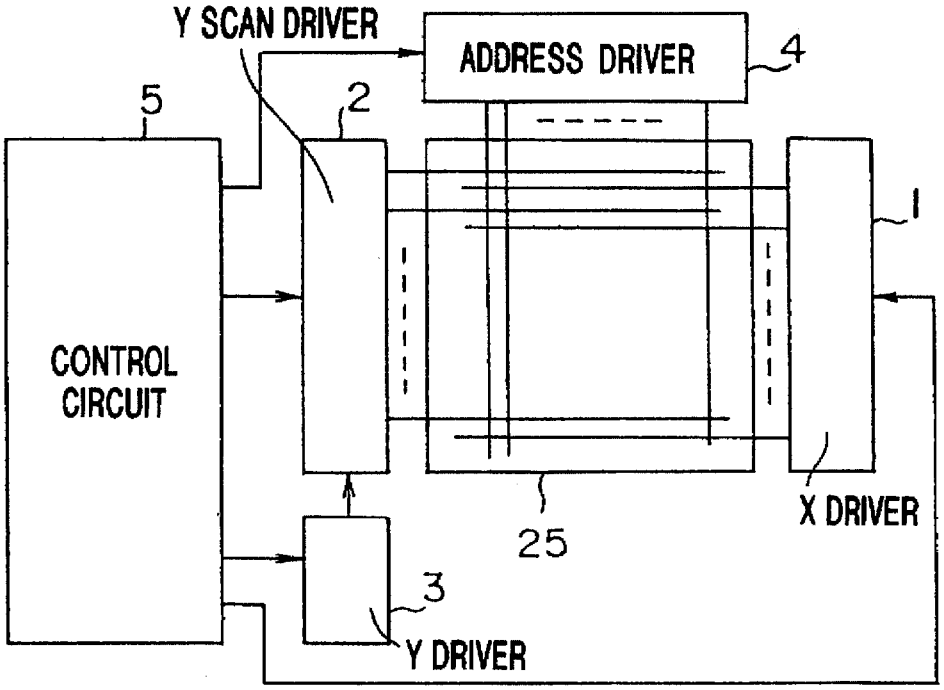
FIG. 1 PRIOR ART
FIG. 1 is a block diagram showing a controller of an AC type PDP according to the related art of the present invention.
Figure 2:
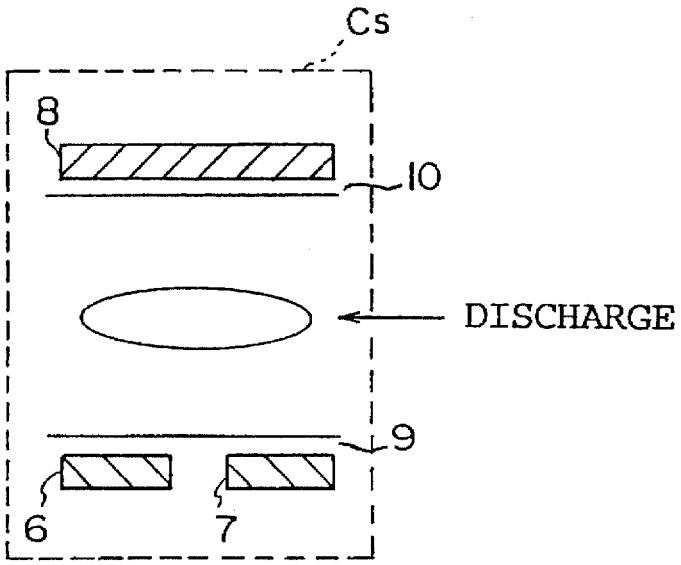
FIG. 2 PRIOR ART
FIG. 2 is a block diagram showing a section of a display cell of one bit of the controller of the AC type PDP shown in FIG. 1.
Figures 3A, 3B, 3C, 3D:
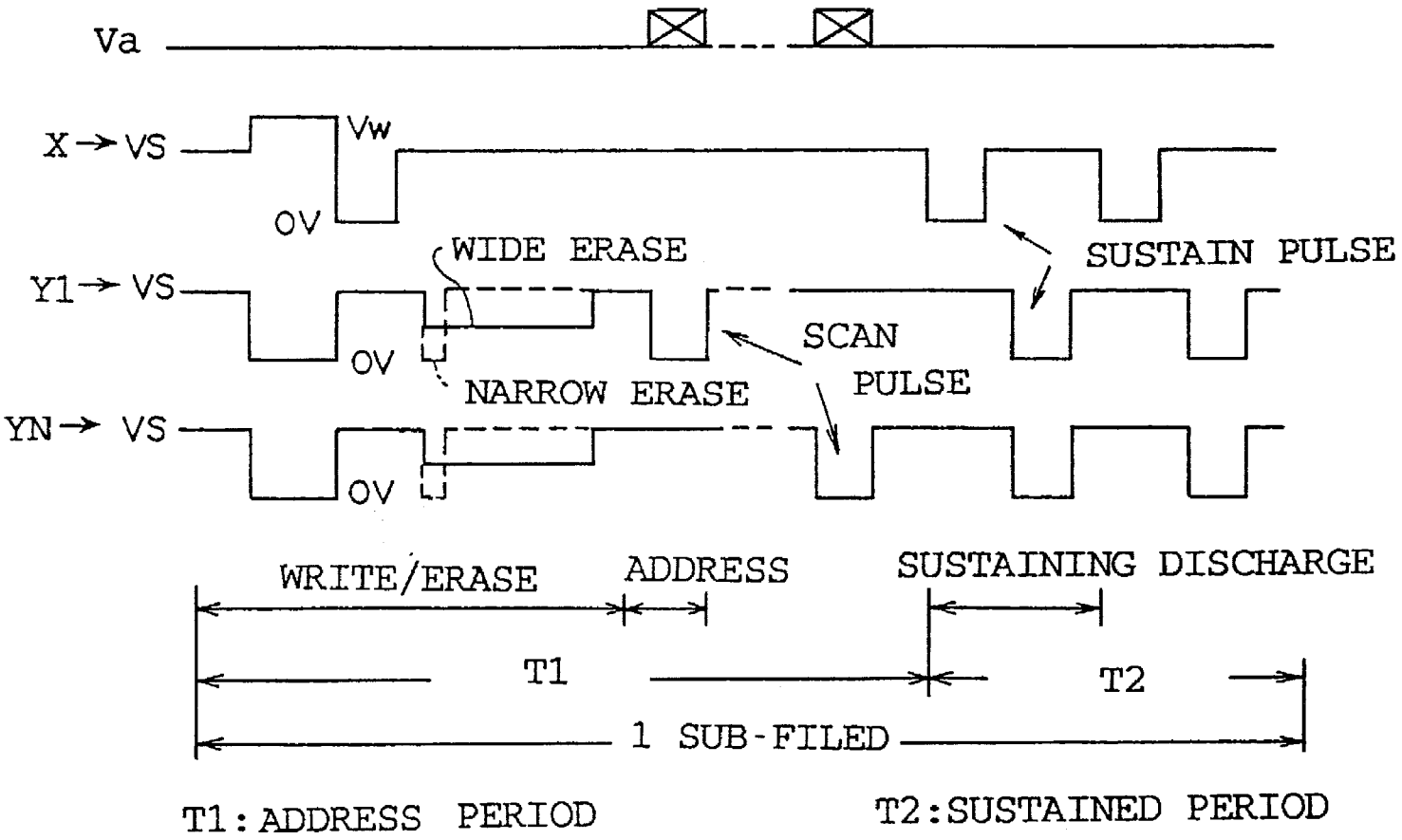
FIG. 3A PRIOR ART
FIG. 3B PRIOR ART
FIG. 3C PRIOR ART
FIG. 3D PRIOR ART
FIGS. 3A through 3D show operation waveform diagrams of the controller of the AC type PDP shown in FIG. 1.
Figure 4A:
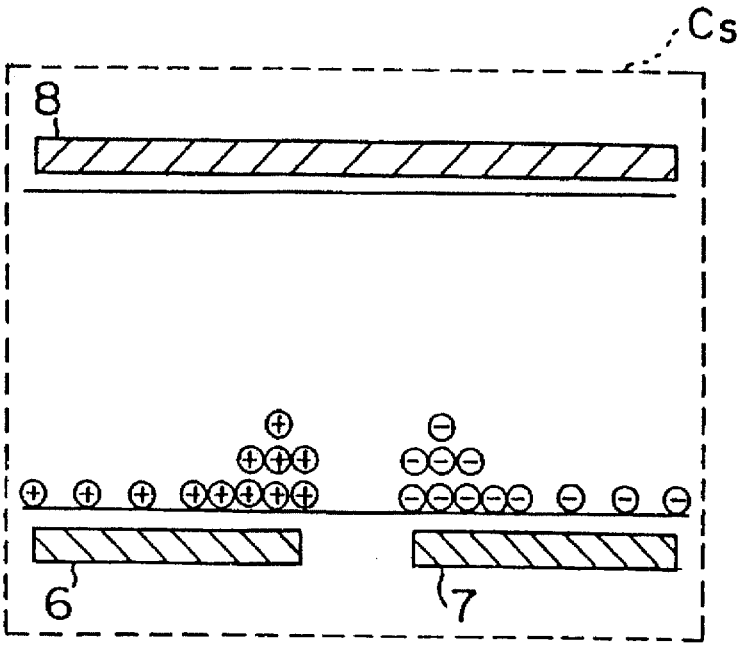
FIG. 4A PRIOR ART
FIG. 4A shows a cross-section showing a wide erasing operation for explaining problems of the display cell shown in FIG. 2.

When there is dispersion in the discharge starting voltage in each display cell Cs, however, such a problem as described hereunder arises. FIG. 4A shows distribution of wall electric charges in a wide range on the X and Y electrodes 6 and 7 immediately before wide erasing discharge is performed.

The wide erasing operation is performed in such a manner that voltage lower than the sustain pulse is applied between the X and Y electrodes 6 and 7 for a long period of time, thereby to neutralize (remain behind partially) wall electric charges. The process proceeds to discharge immediately after application of the pulse in the wide erasing operation. However, small-scale discharge is generated as shown in FIG. 4B which is different from a normal sustain discharge since the applied voltage is low.

Accordingly, the area where discharge is generated is extremely limited to the neighborhood of the gap between the X and Y electrodes 6 and 7 (hereinafter referred to as a discharging gap), and only wall electric charges in the neighborhood of the discharge gap are neutralized.

Figure 4B:
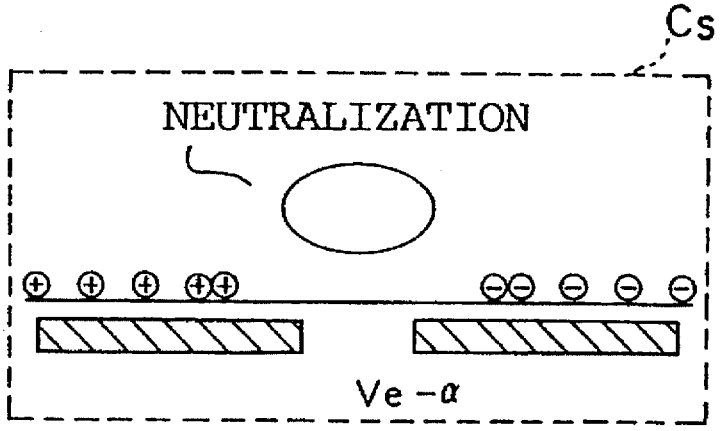
FIG. 4B PRIOR ART
FIG. 4B shows a cross-section for explaining a small-scale discharge state of the display cell shown in FIG. 2.
Figure 4C:
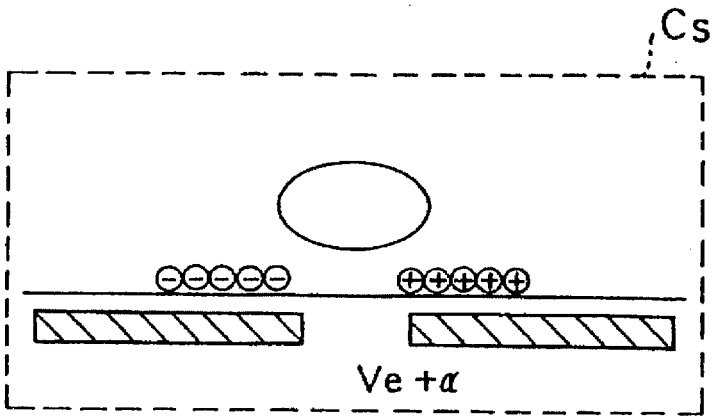
FIG. 4C PRIOR ART
FIG. 4C shows a cross-section for explaining a large-scale discharge state of the display cell shown in FIG. 2.

On the contrary, when voltage which is lower than the sustain pulse but higher than the voltage in the case of FIG. 4B is applied, it becomes no longer possible to perform the erasing operation because the state approaches the sustained discharge state. In other words, it is important to have effective wall electric charges remain behind by the smallest-scale discharge in the wide erasing operation.

Therefore, wall electric charges wherein discharge is too small in scale and the wall voltage and the voltage of the sustain pulse exceed the discharge starting voltage should not be made to remain behind. The wall voltage means voltage of wall electric charges.

Since there is dispersion in the discharge starting voltage in each display cell Cs, when it is intended to generate small-scale discharge with a certain display cell Cs as a reference, discharge itself is not generated and a state that the erasing operation cannot be performed is produced in a cell having a higher discharge starting voltage than that of the display cell Cs.

Further, when it is intended to start discharge in all of the display cells Cs, there is a problem that a sufficiently large discharge is generated, and is shifted to a normal sustained discharge in a cell having a low discharge starting voltage.

Figure 5A:
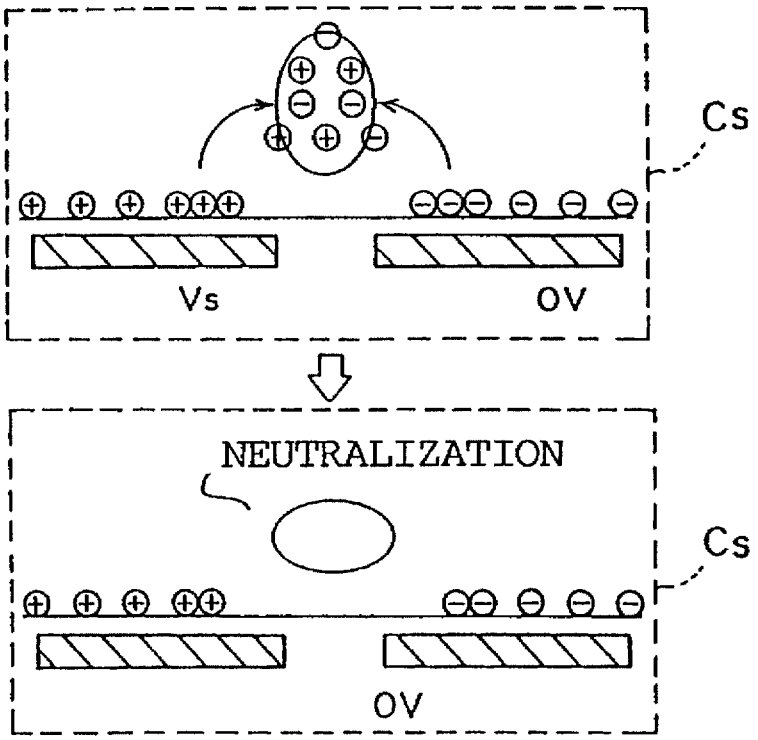
FIG. 5A PRIOR ART
FIG. 5A shows a cross-section showing a discharge initial stage at a time of a narrow erasing operation for explaining problems of the display cell shown in FIG. 2.

FIG. 5A shows distribution of wall electric charges on the X and Y electrodes 6 and 7 at an initial stage of discharge at a time of the narrow erasing operation.

In the narrow erasing operation, the sustain pulse is removed before the discharge between the X and Y electrodes 6 and 7 is completed, but a state that wall electric charges can be neutralized completely and a state that wall electric charges cannot be neutralized completely are generated depending on the timing. Furthermore, in the state that the wall electric charges cannot be neutralized completely, there are a case that wall electric charges having a polarity the same as that of the narrow erasing pulse remain behind and a case that wall electric charges having a polarity reverse to that of the pulse remain behind.

For example, in the former case, since the narrow erasing pulse is removed immediately before all the wall electric charges existing immediately after application of the pulse participate in discharge as shown in FIG. 5A, it becomes difficult to generate space charges for neutralizing all of the wall electric charges. With this, the wall electric charges remain in a state as they are at positions apart from the discharge gap.

Figure 5B:
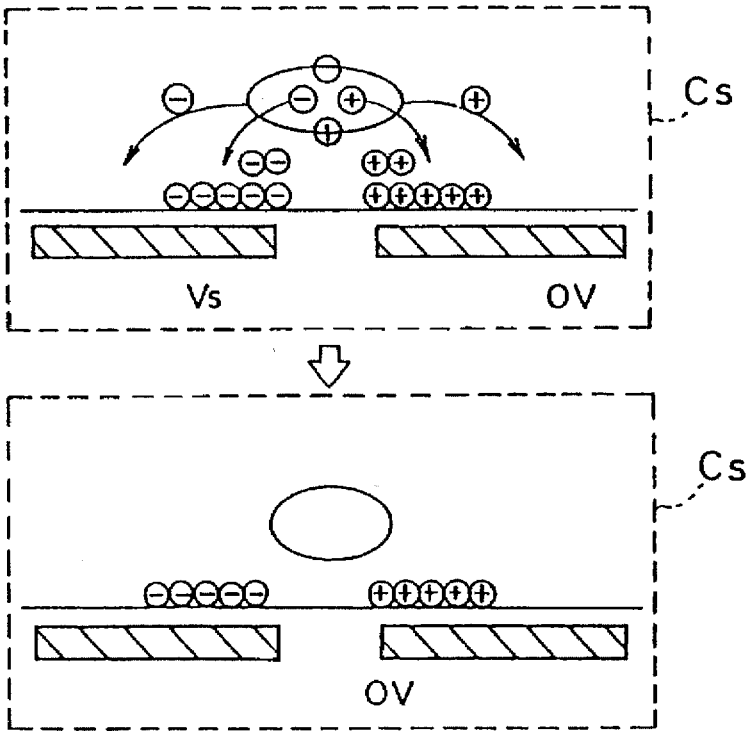
FIG. 5B PRIOR ART
FIG. 5B shows a cross-section for explaining a state at a later stage of discharge of the display cell shown in FIG. 5A.

On the other hand, in the latter case, as shown in FIG. 5B, the pulse application period of time elapses and discharge proceeds considerably, and thus the wall electric charges existing at positions apart from the discharge gap participate in discharge as shown by the distribution of the wall electric charges on the X and Y electrodes 6 and 7 at a latter stage of discharge.

At this point of time, however, absorption of space charges has advanced already in the discharge gap by the applied voltage, and the space charges are adsorbed as wall electric charges. As a result, the operation approaches sustained discharge operation as shown in FIG. 5B.

Therefore, if the sum of the wall voltage and the voltage of the sustain pulse does not exceed the discharge starting voltage, no problem is produced as the erasing operation. Since there is also dispersion in a discharge delay time in each display cell Cs practically, however, it is pretty difficult to perform a sure erasing operation over the whole PDP 25. Further, in the case of the write address method, the problem is more serious because the residual wall electric charge quantity also exerts an influence upon an operation margin of the address discharge.

Next, an influence exerted by the difference between residual wall electric charge quantities related to wide erasing and narrow erasing operations will be described.

In the write address method, stable address operation becomes possible at a low applied voltage since effective wall electric charges are formed immediately before address discharge. That is to say, when it is assumed that a discharge starting voltage between the address electrode 8 and the Y electrode 7 is Vfa, applied voltage between the address electrode 8 and the Y electrode 7 is Va and the wall voltage by wall electric charges accumulated on the address electrode side and wall electric charges accumulated on the Y electrode side is Vwa, conditions to show $Vfa \leqq Va+Vwa$ are required. When these conditions are not satisfied, the address discharge itself is not generated, but the display cell Cs is kept in a state as it is erased.

Further, when it is assumed that the lowest voltage for starting discharge in an adjacent non-selected cell is Vfoa, an inequality $Va+Vwa<Vfoa$ has to be effected. When it is not satisfied, normal discharge is generated in a selected cell, but discharge is also generated in an adjacent non-selected cell.

Furthermore, even when objective address discharge is achieved in a selected cell, generated wall electric charges are too much. Thus, discharge is generated by only the voltage of wall electric charges after removing the pulse, and there is a possibility of giving rise to an erasing operation that is called a self-erasing discharge. When it is assumed that this voltage is Vfse, $Va+Vwa<Vfse$ has to be effected.

After all, the relationships of $Vfa \leqq Va+Vwa<Vfoa$ and $Vfa \leqq Va+Vwa<Vfse$ are required.

Here, since the applied voltages outputted from the Y driver 3 and the address driver 4 are all constant, Vwa has to be determined so as to satisfy the above expressions. From the viewpoints described above, the erasing pulse has an important object to have wall electric charges in a predetermined quantity remain behind in addition to perform erasing which is the original object in the write address method.

Furthermore, it is effective to have wall electric charges, which do not exceed Vfoa–Va and Vfse–Va but are close thereto, remain behind in order to realize a low voltage address.

Further, normally, when the complete write pulse is removed, either the potential difference between the X electrode 6 and the Y electrode 7 is made OV sharply or a sustain pulse of a reverse polarity is applied to the sustain electrode. In case too large a quantity of wall electric charges are formed by complete write discharge, a method of making the potential difference between two sustain electrodes OV is conceivable. However, discharge is generated only by the wall electric charges, thus loosing wall electric charges enough for proceeding to sustained discharge and running into self-erasing operation sometimes.

In that case, the operation becomes impossible thereafter. Further, when a sustain pulse of a reverse polarity is applied immediately after application of the pulse, such a problem is also produced that discharge is started during the application process of the pulse (at rising time of the voltage) and normal sustained discharge can no longer be performed.

Figure 6:
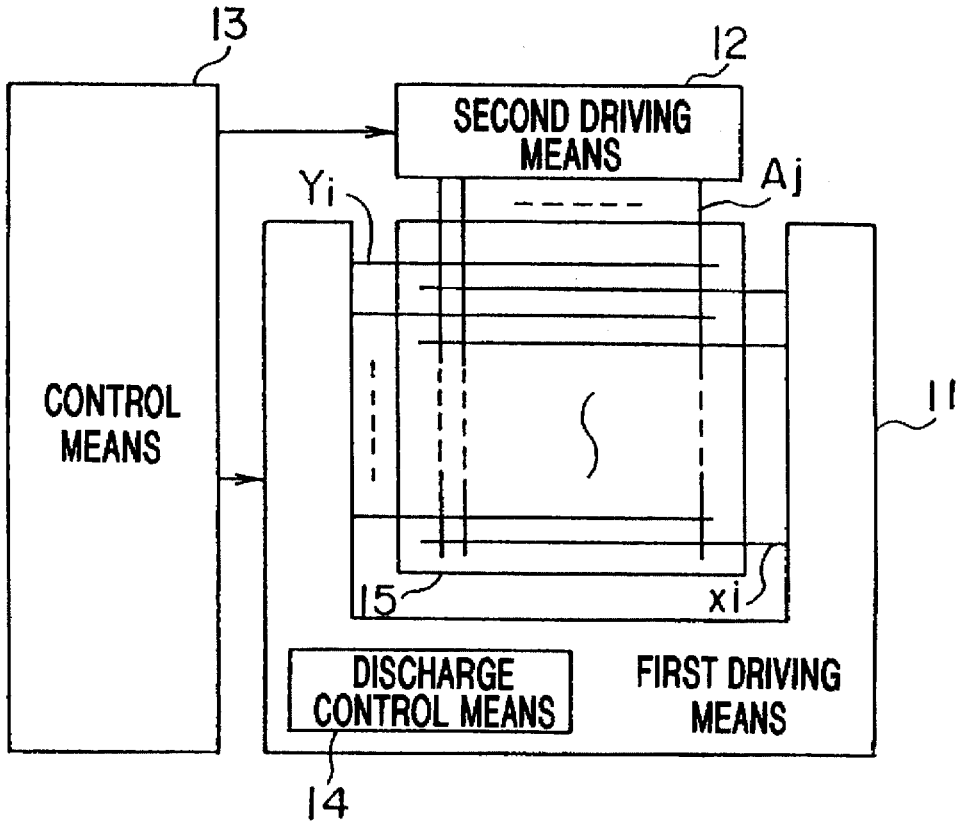
FIG. 6 is a block diagram showing a controller of a plasma display panel in principle according to the present invention.

As against the above, FIG. 6 shows a controller of a plasma display panel in principle of the present invention provided with first driving means 11 for applying voltage to sustain electrodes X, Yi, where i=1 to N, display means 15 having a memory function, second driving means 12 for applying voltage to an address electrode Aj of the display means 15 and control means 13 for controlling input-output of the first and the second driving means 11 and 12. Discharge control means 14 is provided in the first driving means 11, and the discharge control means 14 controls a discharge waveform of the voltage applied to the sustain electrodes X, Yi, where i=1 to N, of the display means 15.

Figure 7:
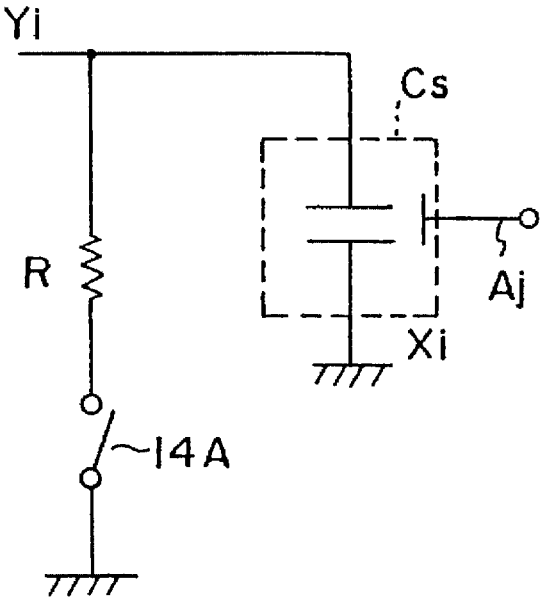
FIG. 7 is a block diagram of discharge control means of the controller shown in FIG. 6.

As shown in FIG. 7, the discharge control means 14 has a bias element R and a switching element 14A, the switching element 14A being connected in series with the delay element R, and the delay element R and the switching element 14A connected in series with each other being connected between the sustain electrodes X and Yi.

Figure 8:
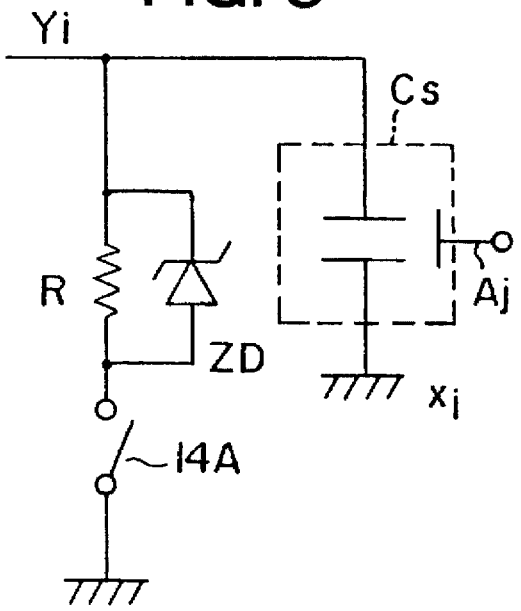
FIG. 8 is a block diagram of another discharge control means of the controller shown in FIG. 6.

Furthermore, in a second controller in principle of the present invention, a constant voltage discrimination element ZD is provided in the discharge control means 14 and the constant voltage discrimination element ZD is connected in parallel with the delay element R as shown in FIG. 8.

Further, the first control method of a plasma display panel in principle of the present invention is a method which includes the sustain electrodes X and Yi and the address electrode Aj as shown in FIG. 9 and the driving of the display means 15 having a memory function. The discharge waveform between the sustain electrodes X and Yi is controlled before selecting the address electrode Aj and after termination of a complete write operation of the display means 15 or after termination of sustained discharge following the above.

Besides, in a first control method, the voltage variation portion of the erasing pulse at the time of the complete erasing operation is applied gently when the discharge waveform between the sustain electrodes X and Yi is controlled as shown in FIG. 10.

Further, in the first control method, the voltage variation portion of the erasing pulse is made constant against the time variation portion.

Furthermore, in a second control method of the present invention, the erasing pulse is applied rapidly during several nanoseconds to several microseconds up to immediately before the smallest value of the minimum sustain voltage of the display cells Cs in the display means 15, and the erasing pulse is applied gently at a rate of several nanoseconds to several microseconds per unit voltage thereafter at the time of the complete erasing operation.

Further, in a third control method of the present invention, a write pulse exceeding the discharge starting voltage is applied to one of the sustain electrodes X and Yi in the complete write operation of the display means 15, and, when the discharge waveform between the sustain electrodes X and Yi is controlled, the potential difference between the sustain electrodes X and Yi is made OV from the potential state at the time of termination of the complete write operation, and then, an erasing pulse having the polarity of the write pulse at the time of the complete write operation is applied up to a value which does not exceed the highest sustain voltage.

Besides, in the first to the third control methods according to the present invention, the voltage, which is a pulse having a polarity the same as that of the address pulse selecting the sustain electrode Yi and is increased up to a value which does not exceed the maximum sustain voltage within several microseconds to several hundred microseconds, is applied between the sustain electrodes X and Yi in the complete write operation of the display means 15.

Further, in the first to the third control methods of the present invention, the potential at a time of non-selection of the address electrode Aj and the potential of the electrode common to each display line among the sustain electrodes X and Yi are fixed as they are at time of application of the erasing pulse, and an erasing pulse having a large gradient is applied to an independent electrode in each display line among the sustain electrodes X and Yi when the discharge waveform between the sustain electrodes X and Yi is controlled.

The operation of the first controller of the present invention will be described. For example, it is possible to control the discharge waveform of the erasing pulse at the time of the complete write of the display means 15 before selecting the address electrode Aj and after termination thereof by the discharge control means 14 having the delay element R and the switching element 14A as shown in FIG. 7.

Namely, the complete write voltage is applied to the sustain electrodes X and Yi from the first driving means 11 through the control means 13, which is a pre-operation of address discharge. At this time, the switching element 14A is turned OFF, and the switching element 14A is switched over to ON operation when the complete write and the succeeding sustained discharge operation are terminated.

With this, in a circuit having the display cell Cs, the delay element R and the switching element 14A, electric charges of the sustain electrodes X and Yi are discharged with the time constant of the circuit. Here, the discharge waveform of the display means 15 is controlled by the discharge control means 14, thus making it possible to have wall electric charges effective for address discharge remain on the sustain electrodes X and Yi.

Thus, it becomes possible to perform the erasing operation efficiently and surely with a simple circuit even when dispersion in the discharge starting voltage is produced in each display cell Cs. Further, it becomes possible to perform normal address discharge by applying an address pulse lower than that in the related art of the present invention to the address electrode Aj from second driving means 12.

Next, the operation of a second controller of the present invention will be described. For example, when the characteristic voltage of the constant voltage discrimination element ZD is set in advance at lower than the minimum sustain voltage with respect to the sustain voltage between the sustain electrodes X and Yi, it is possible to control very finely the discharge waveform of the erasing pulse at the time of the complete write of the display means 15 before selection of the address electrode Aj and after the termination thereof by the discharge control means 14 including the constant voltage discrimination element ZD.

Namely, similarly to the first controller of the present invention, the complete write voltage is applied to the sustain electrodes X and Yi from the first driving means 11, which is the pre-operation of address discharge. At this time, the switching element 14A is turned OFF, and the switching element 14A is switched over to ON operation when complete write and sustained discharge operation following thereto are terminated.

Thus, a current is applied to the delay element R and the constant voltage discrimination element ZD at the time of the complete erasing operation by the ON operation of the switching element 14A. At this time, a current flows abruptly because there is no component for limiting the current in a state that the voltage of the sustain electrode Yi is at the characteristic voltage of the delay element R or higher. Further, when the voltage in the interim falls below the characteristic voltage, the current no longer flows in the constant voltage discrimination element ZD. Thereafter, electric charges on the sustain electrodes X and Yi are discharged with the circuit time constant based on the display cell Cs and the delay element R.

With this, it becomes possible to obtain an erasing pulse which shows abrupt change in the waveform at the initial stage of erasing and changes the gradient largely thereafter, and it also becomes possible to have wall electric charges, effective for address discharge, remain on the sustain electrodes X and Yi even when dispersion is produced in the discharge starting voltage in each display cell Cs.

Further, according to the first control method of the present invention, the voltage (hereinafter referred to as an erasing pulse), which is a pulse having a polarity the same as that of the discharge pulse selecting the address electrode Aj and is increased up to a value which does not exceed the maximum sustain voltage within several microseconds to several hundred microseconds, is applied between the sustain electrodes X and Yi as shown in FIG. 9 in the complete write operation of the display means 15.

Further, when the discharge waveform between the sustain electrodes X and Yi is controlled, the potential at the time of non-selection of the address electrode Aj and the potential of the electrode being common in each display line among the sustain electrodes X and Yi are fixed as they are at the time of application of the erasing pulse, and the erasing pulse having a large gradient is applied to an independent electrode in each display line among the sustain electrodes X and Yi.

Furthermore, at the time of the complete erasing operation, the voltage variation portion of the erasing pulse becomes constant with respect to the time variation portion as shown in FIGS. 10A through 10D, and discharge control is made so that the voltage variation portion of the erasing pulse becomes constant with respect to the time variation portion from the voltage value exceeding the smallest value of the minimum sustain voltage of the display cell Cs in the display means 15.

As a result, when the sum of the voltage value applied between the sustain electrodes X and Yi and the voltage value by wall electric charges which have been accumulated in the display cells Cs shows a value slightly exceeding the discharge starting voltage value in the space, the wall electric charges participating in the discharge are only those at the shortest positions of the sustain electrodes X and Yi where the field strength is the highest in the discharge space.

In this case, the quantity of wall electric charges neutralized even after discharge is terminated is very small, and it is possible to have a large amount of wall electric charges remain within a range where sustained discharge is not generated even when the sustain voltage is applied. Besides, due to the fact that the polarity of remaining wall electric charges becomes equivalent to the polarity of the wall electric charges immediately before the erasing discharge is performed, for example, electrons remain on the sustain electrode Yi side, and ions remain on the sustain electrode X side.

With this, it is possible to perform the erasing operation over the whole picture plane surely as compared with the related art of the present invention, and to display an excellent picture image having no erasing mistake. Furthermore, it becomes possible to accumulate wall electric charges acting effectively on the address discharge before the address discharge (selective write discharge) is performed, and to perform sustained discharge by a low applied voltage (address voltage). This fact contributes greatly to achieve small power consumption and integration of a circuit.

Furthermore, according to the second control method of the present invention, even when dispersion of the discharge starting voltage is produced in each display cell Cs, for instance, it is possible to have wall electric charges effective for address discharge remain on the sustain electrodes X and Yi by an erasing pulse in which the waveform falls abruptly at the initial stage of erasing and the gradient shows a big change thereafter.

Namely, the wall electric charges participating in discharge become less as compared with the first control method of the present invention, thus making it possible to neutralize the space charges and have a large quantity of wall electric charges acting effectively on the address discharge remain behind as a result of the above.

With this, even when there is dispersion to some degree in the discharge starting voltage in each display cell Cs, it is possible to have a large quantity of wall electric charges remain in a limited period of time and it becomes possible to perform low voltage address discharge without getting into the self-erasing operation as experienced in the related art of the present invention. Thus, it becomes possible to evade a write mistake and perform excellent picture image display.

Further, according to a third control method of the present invention, it becomes possible, being different from the first and the second control methods, to perform erasing discharge in which an almost constant wall electric charge quantity is made to remain on the sustain electrodes X and Yi without through sustained discharge after applying a complete write pulse between the sustain electrodes X and Yi and executing complete write discharge.

With this, even when too large a quantity of wall electric charges are generated on the sustain electrodes X and Yi by the complete write operation, it becomes possible to make the residual wall electric charge quantity constant until before the address discharge. Thus, it becomes possible to avoid a write mistake and show an excellent picture image display.

Next, preferred embodiments of the present invention will be described with reference to the drawings.

(1) Description of the First Preferred Embodiment

Figure 11:
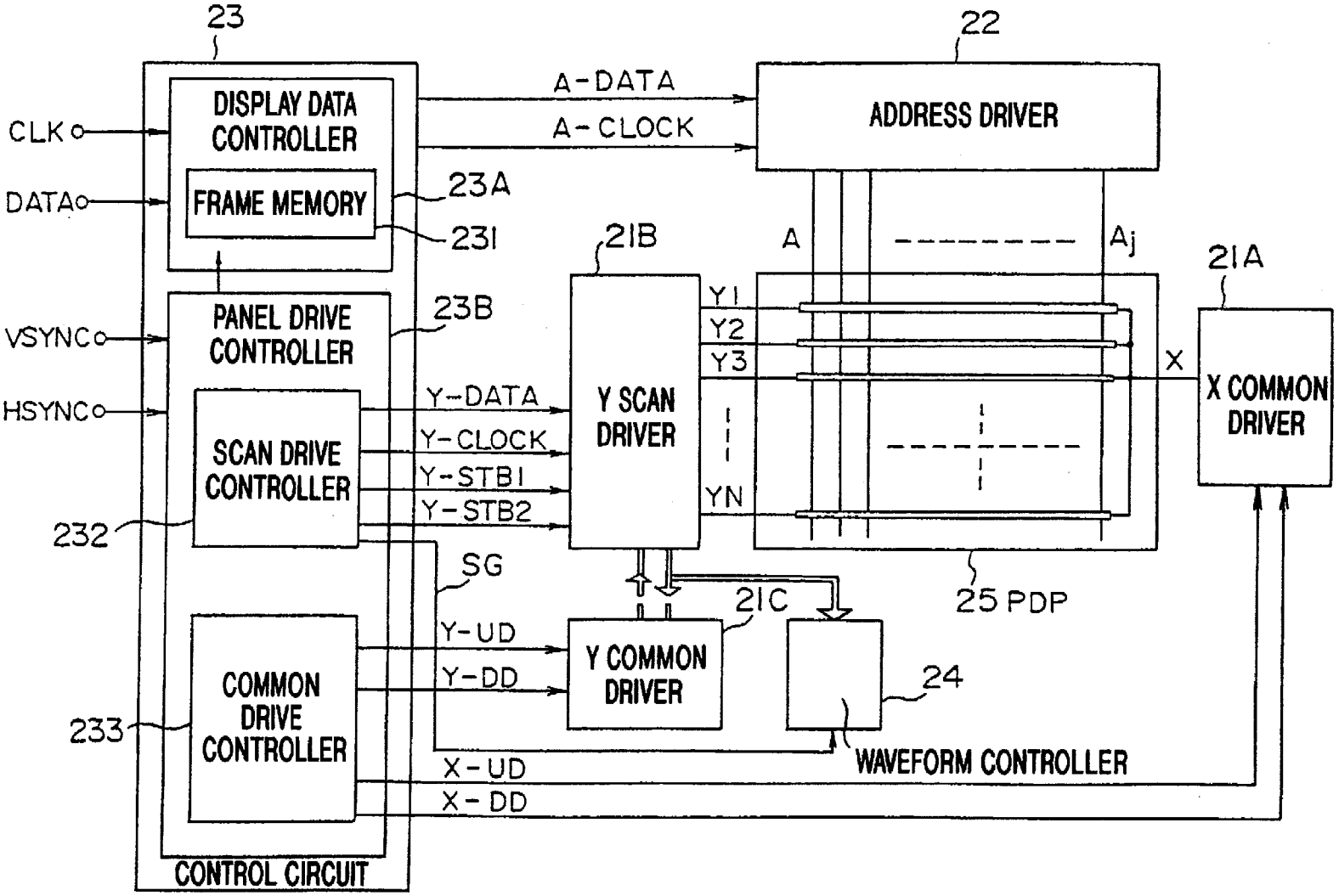
FIG. 11 is a general block diagram of a controller of an AC type PDP according to respective preferred embodiments of the present invention.

For example, a controller for controlling a three-electrode surface discharge type PDP 25 has an X common driver 21A, a Y scan driver 21B, a Y common driver 21C, an address driver 22, a control circuit 23 and a waveform controller 24 as shown in FIG. 11.

Figure 12A:
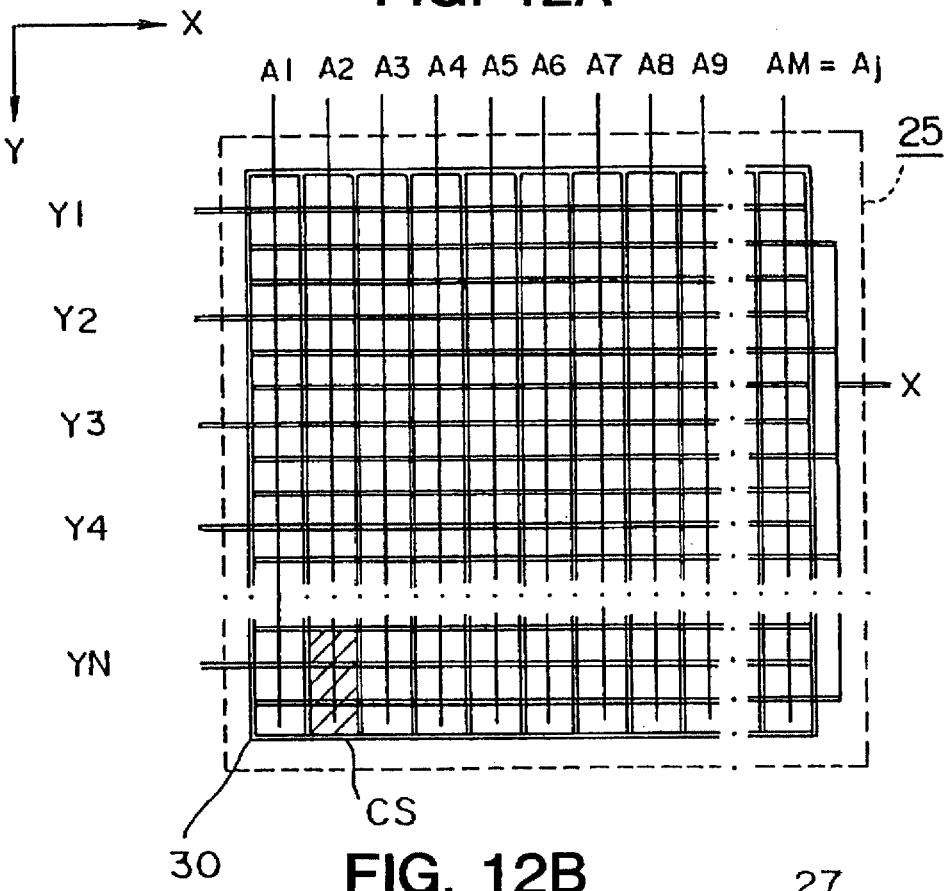
FIG. 12A is a plan view of a display panel of the controller of the AC type PDP shown in FIG. 11.

Namely, the X common driver 21A, the Y scan driver 21B and the Y common driver 21C form an example of first driving means 11, and the X common driver 21A is a circuit for applying voltage to a sustain electrode X (hereinafter referred to simply as an electrode X) of the PDP 25 having a memory function. For example, the X common driver 21A generates a write pulse Vw, a sustain pulse Vs or the like based on drive control signals (hereinafter referred to as signal X-UD and signal X-DD). Besides, at the electrode X, N lines (N=1 to i . . . N) of the PDP 25 are connected in common as shown in FIG. 12A.

The Y scan driver 21B is a circuit for scan-driving the sustain electrode Yi (hereinafter referred to simply as an electrode Yi) of N lines (i=1 to N). The Y scan driver 21B generates scan pulses based on scan data (hereinafter referred to as a Y-DATA signal), a scan clock signal (hereinafter referred to as a Y-CLK signal) and strobe signals (hereinafter referred to as Y-STB1 and Y-STB2 signals) at the time of address discharge. Besides, the Y common driver 21C is a circuit for controlling input-output of the Y scan driver 21B based on the drive control signals (hereinafter referred to as Y-UD and Y-DD signals).

The address driver 22 is an example of the second driving means 12 and is a circuit for applying voltage to address electrodes Aj where j=1 to M (R,G,B), of the PDP 25. For example, the address driver 22 generates address pulses based on address data (hereinafter referred to simply as an A-DATA signal) and an address clock signal (hereinafter referred to simply as an A-CLK signal), and applies these signals to the address electrode Aj at the time of address discharge.

The control circuit 23 is an example of the control means 13, and is a circuit for controlling input-output of the X common driver 21A, the Y common driver 21C and the Y scan driver 21B. For example, the control circuit 23 has a display data controller 23A and a panel drive controller 23B. The display data controller 23A is provided with a frame memory 231, and controls write/read of picture image display data (hereinafter referred to simply as a DATA signal), based on a picture image clock signal (hereinafter referred to simply as a CLK signal).

The panel drive controller 23B has a scan driver controller 232 and a common driver controller 233. The scan driver controller 232 receives a vertical synchronizing signal (hereinafter referred to simply as a VSYNC signal) and a horizontal synchronizing signal (hereinafter referred to simply as an HSYNC signal), and generates a Y-DATA signal, a Y-CLK signal, Y-STB1 and Y-STB2 signals and a gate control signal GS and supplies these signals to the Y scan driver 21B and a waveform controller 24. The common driver controller 233 generates Y-UD and Y-DD signals based on the VSYNC signal and the HSYNC signal and supplies these signals to the Y common driver 21C.

The waveform controller 24 is an embodiment of the discharge control means 14. It is provided between the Y common driver 21C and the Y scan driver 21B and controls the discharge waveform of the PDP 25 based on the gate control signal GS. Besides, the internal circuit of the waveform controller 24 will be described in detail with reference to FIG. 13, and the function thereof, i.e., the display control of the PDP 25 will be described in detail with reference to FIGS. 15A through 15D and FIGS. 16A to 16D.

Further, the PDP 25 has N lines×M rows×3 (R,G,B) pieces of display cells Cs in the case of color display as shown in a plan view of FIG. 12A. The display cell Cs has a memory function. Namely, M pieces of address electrodes A1 to AM are arranged in the X-direction of the PDP 25, and are connected to the address driver 22 line after line.

Y1 electrode to YN electrode in N lines are arranged in the Y-direction of the PDP 25 and connected to the Y scan driver 21B individually. Besides, the X electrode is juxtaposed to Y1 electrode to YN electrode in N lines, and are connected in common and connected further to the X common driver 21A.

Figure 12B:
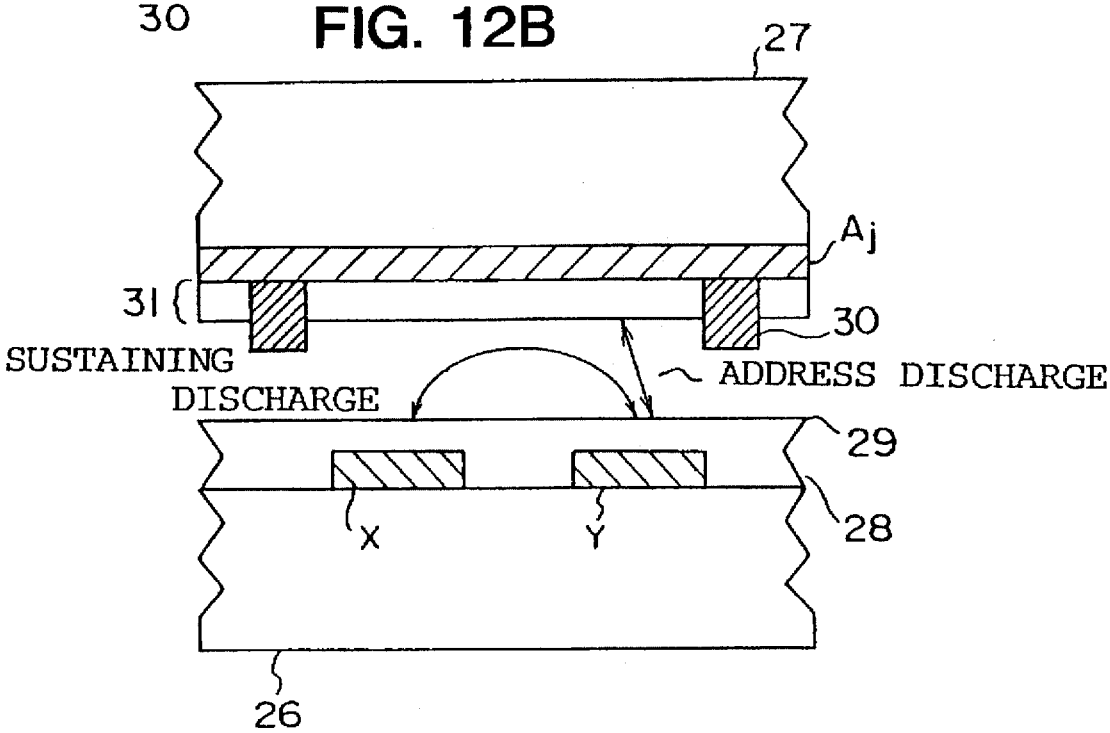
FIG. 12B is a sectional view of a display cell of one bit of the display panel shown in FIG. 12A.
Figures 15A, 15B, 15C, 15D:
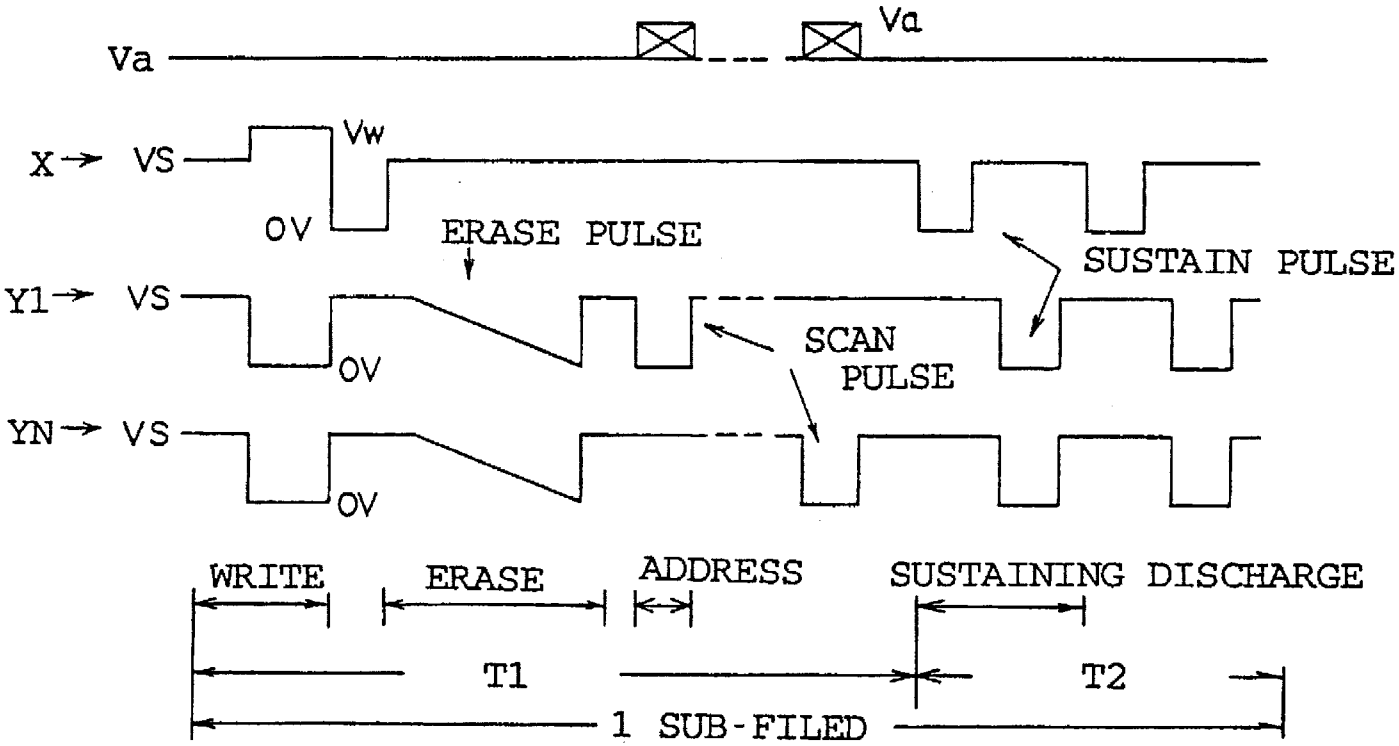
FIGS. 15A through 15D show waveform diagrams for explaining a control method according to the first preferred embodiment of the present invention.

Furthermore, in the display cell Cs of one bit, a space between a rear glass substrate 26 and a front glass substrate 27 opposing each other is partitioned by walls (barriers) 30 and the X electrode, the Y electrode and the address electrode Aj are provided in the areas sectioned by both glass substrates 26 and 27 and the walls 30 as shown in the sectional view of FIG. 12B.

On the rear glass substrate 26 the X electrode and the Y electrode are provided in parallel with each other on the same plane, and a dielectric layer 28 is provided on both electrodes and a magnesium oxide (MgO) film is formed on the dielectric layer 28 as a protective film. Further, the address electrode Aj is provided at a position opposing to those layers and meeting at right angles with the X and Y electrodes, and on the front glass substrate 27. Besides, a phosphor 31 having luminous characteristics of red, green and blue is provided on the surface of the electrode Aj.

Further, the waveform controller 24 for controlling the discharge waveform of the display cell Cs of one bit has an n-type field effect transistor (hereinafter referred to simply as a transistor FET) and a resistance R as shown in FIG. 13.

Namely, the transistor FET is an example of the switching element 14A, in which the gate thereof is connected to the scan driver controller 232 and the source thereof is connected to the ground line GND. The resistance R is an example of the delay element R, and one end thereof is connected to the Y1 electrode and the other end thereof is connected to the drain of the transistor FET.

As to the function of the waveform controller 24, the transistor FET is shifted to ON operation when the gate control signal GS outputted from the scan driver controller 232 is at an "H" level when the complete write operation is terminated. With this, after the complete write pulse is applied, an erasing pulse which shifts the pulse voltage at a constant rate of variation (time variation portion against voltage variation portion) is obtainable.

Here, the gradient of the erasing pulse changes depending on the time constant determined by electrostatic capacity C and resistance R existing among electrodes of the display cell Cs. In other words, when it is assumed that the potential difference when the erasing pulse is terminated in Vs and the potential difference between the X electrode and the Y1 electrode at time t is Vt, the relationship between both is expressed by an expression $Vt=Vs\ (1-e^{-t/CR})$. As a result, it is possible to control the waveform as shown in FIGS. 14A through 14C and to obtain a sufficiently small potential gradient in the discharge voltage area.

Thus, according to a controller of a plasma display according to the first embodiment of the present invention, there are provided the X common driver 21A, the Y scan driver 21B, the Y common driver 21C, the address driver 22, the control circuit 23 and the waveform controller 24 as shown in FIG. 11 to FIG. 13. The waveform controller 24 is provided between the Y scan driver 21B and the Y common driver 21C.

As a result, it is possible to control the discharge waveform of the erasing pulse at the time of the complete write of the PDP 25 before selection of the address electrode Aj or after termination thereof by the waveform controller 24 having the resistance R and the transistor FET as shown in FIG. 13.

Namely, a complete write pulse Vw is applied first, to the electrodes X and Yi from the X common driver 21A or the Y scan driver 21B through the control circuit 23, which is a pre-operation of address discharge. At this time, the transistor FET is turned OFF, and, when the complete write operation and following sustained discharge operation are terminated, the transistor FET is shifted to ON operation.

With this, in the discharge circuit having the capacity C, the resistance R and the transistor FET of the display cell Cs, electric charges on the electrodes X and Yi are discharged with the circuit time constant $\tau$=RC. Here, the discharge waveform of the PDP 25 is controlled by the waveform controller 24, thus making it possible to have wall electric charges effective for address discharge remain on the electrodes X and Yi.

As a result, it becomes possible to perform the erasing operation efficiently and surely with a simple circuit even when dispersion in the discharge starting voltage is produced in each display cell Cs. Further, it becomes possible to perform normal address discharge by applying a lower address pulse as compared with the related art of the present invention to the address electrode Aj from the address driver 22.

Next, a control method according to the present invention will be described while supplementing the operation of the controller concerned.

For example, one driving cycle (equivalent to one sub-field) related to the display cell Cs of one bit, in the case of controlling the PDP 25 by a system of address/sustained discharge separation type, will be described. As shown in FIGS. 15A through 15D, a write pulse having voltage Vw is applied to the X electrode first and write is executed over the whole cells.

Figure 16A:
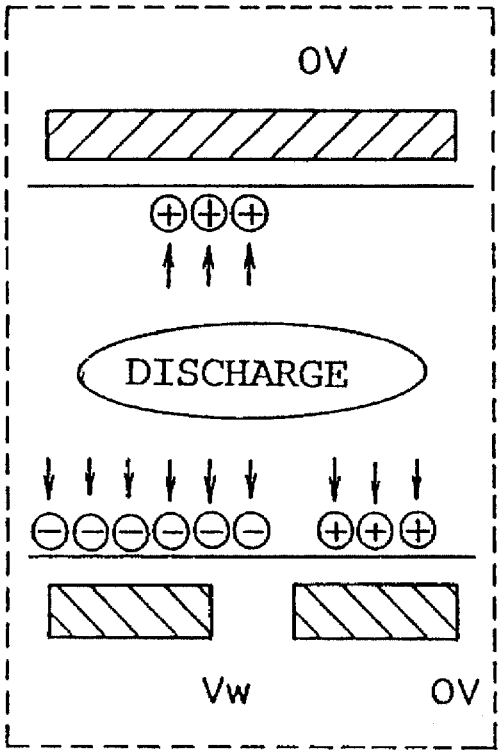
FIG. 16A through FIG. 16D are diagrams for supplementarily explaining a control method according to the first and second preferred embodiments of the present invention.
Figure 16B:
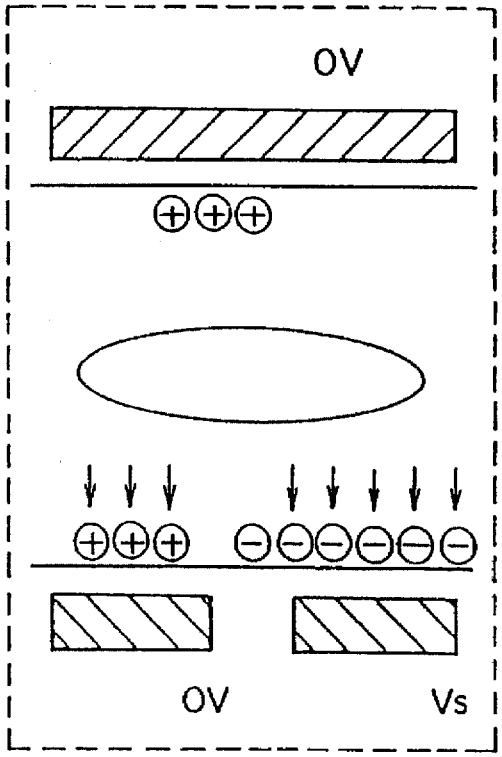

Here, when complete write operation of the PDP 25 is performed, positive electric charges (ions) are accumulated on the address electrode Aj as shown in FIG. 16A. Next, a pulse having voltage Vs is applied to the electrode Y1, and the whole display cell Cs perform sustained discharge as shown in FIG. 16B.

Then, an erasing pulse of a negative polarity is applied to the electrode Y1. Here, "to apply a pulse of a negative polarity" means to apply voltage in a minus direction with the voltage immediately before the concerned pulse started as a reference. In other words, it is an erasing pulse applied from the sustain voltage VS toward OV. To be concrete, the potential at the time of non-selection of the address electrode Aj and the potential of the electrode X are fixed as they are. The electrode X is an electrode common to each display line among the electrodes X and Yi. An erasing pulse having a large gradient is applied to the electrode Yi. The electrode Yi is an independent electrode in each display line among the electrodes X and Yi.

Figure 16C:
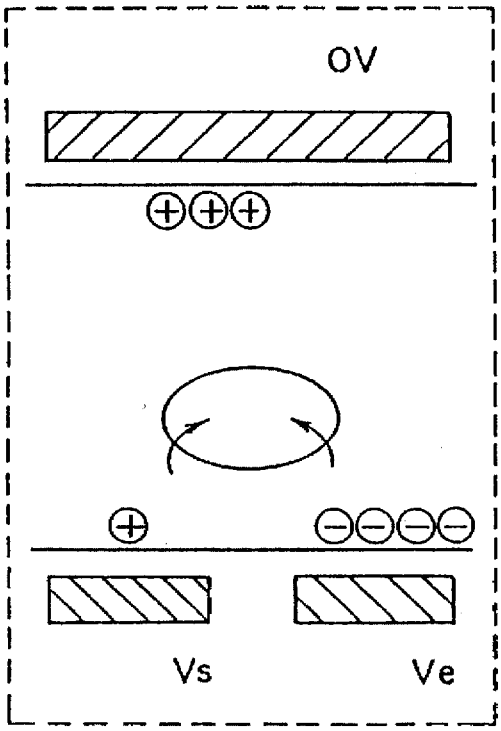

This erasing pulse is a pulse which has the same polarity as that of the scan pulse for selecting the electrode Yi, and is increased up to a value which does not exceed the maximum sustain voltage during several microseconds to several hundred microseconds. This erasing pulse is applied between the electrodes X and Yi. Besides, this erasing pulse resembles the mechanism of the wide erasing operation of the related art of the present invention. The erased state is realized by neutralization of wall electric charges which is performed by absorption of space electric charges by the applied voltage. With this, all the display cells Cs show the erasing operation as shown in FIG. 16C.

At this time, the wall electric charges on the electrodes X and Yi are reduced. To be concrete, reduction is made down to such a value that discharge is not generated even if the sustain voltage Vs is applied. It is preferable to control discharge so that the voltage variation portion becomes constant with respect to the time variation portion or the voltage variation portion of the erasing pulse from a voltage value which has exceeded the smallest value of the minimum sustain voltage of the display cells Cs in the PDP 25 becomes constant with respect to the time variation portion.

Here, when the sum of the potential difference between the X electrode and the Y1 electrode and the voltage value by the wall electric charges accumulated in the display cell Cs shows a value slightly exceeding the discharge starting voltage value in this space, it is only the wall electric charges at the shortest point from the X electrode and the Y1 electrode where the field intensity is highest that participate in discharge in the discharge space.

In that case, the quantity of wall electric charges which is neutralized even after discharge is terminated is small, and a large quantity of wall electric charges remain behind in a range where sustained discharge is not generated even if the sustain voltage VS is applied also after erasing discharge is terminated.

Thus, since the polarity of residual wall electric charges is the same polarity as the wall electric charges immediately before the erasing discharge is performed, electrons (negative electric charges) remain on the Y1 electrode side and ions (positive electric charges) remain on the X electrode side as shown in FIG. 16C. Besides, erasing discharge is performed at some point of the gradient of the potential in the whole display cells Cs. Thereafter, write discharge (address discharge) is executed in line sequence.

Figure 16D:
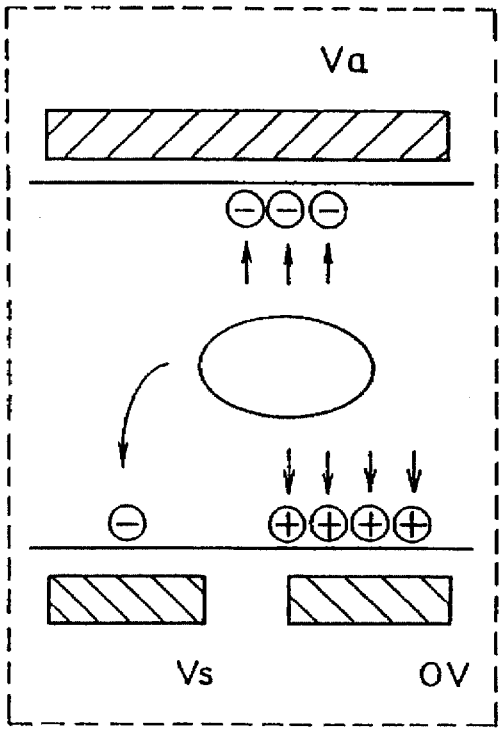

Furthermore, in FIG. 16D, selective write (address discharge) of the display cell Cs is executed. The voltages participating in the write discharge are by positive voltage Va applied to the address electrode Aj, positive ions accumulated on the phosphor surface on the address electrode side and electrons accumulated on the dielectric surface on the Y1 electrode side. The positive voltage Va is a potential between the address electrode Aj and the Y1 electrode, and positive ions are the positive wall electric charges and electrons are negative wall electric charges.

Besides, the electrons on the Y1 electrode side are formed by the erasing pulse described previously. On the other hand, ions on the address electrode side are formed and accumulated by complete write discharge.

Further, after address discharge is performed in the whole display lines, the sustain pulse is applied alternately to the X electrode and the Y1 electrode over the whole picture plane, thus repeating sustained discharge. With this, when the sustaining discharge period with respect to the first sub-field is terminated, complete write discharge is performed similarly in the next sub-field, complete erasing discharge is executed further, and the address discharge is executed again through the processes. With this, it is possible to control the PDP 25.

Thus, according to the control method related to the first embodiment of the present invention, the discharge waveform between the X and Yi electrodes is controlled before selecting the address electrode Aj of the PDP 25 and after the complete write and the sustained discharge operation immediately thereafter are terminated as shown in FIGS. 15A through 15D.

As a result, when the sum of the voltage applied between the X and Yi electrodes and the voltage value by the wall electric charges accumulated in the display cell Cs shows a value slightly exceeding the discharge starting voltage value of the space, only the wall electric charges at the shortest point from the X and Yi electrodes where the field intensity is highest remain behind in the discharge space as the wall electric charges participating in the discharge.

In this case, the quantity of the wall electric charges that are neutralized is small even when the discharge is terminated, and it is possible to have a large quantity of wall electric charges remain behind in a range where sustained discharge is not produced even when the sustain voltage is applied after the erasing discharge is terminated. Besides, since the polarity of the residual wall electric charges becomes equivalent to the polarity of the wall electric charges immediately before the erasing discharge is performed, it becomes possible to have electrons remain on the Y1 electrode side and ions remain on the X electrode side.

With this, it is possible to perform the erasing operation surely over the whole picture plane as compared with the related art of the present invention, and it becomes possible to make excellent picture image display with no erasing mistake. Further, it becomes possible to accumulate wall electric charges acting effectively on the address discharge before address discharge is performed. As a result, it becomes possible to conduct address discharge at a low applied voltage. This fact contributes greatly to achieve low power consumption and integration of the circuit in the controller concerned.

(2) Description of the Second Preferred Embodiment

Being different from the first embodiment, a Zener diode ZD is provided in a waveform controller 34 in a second embodiment.

Namely, the Zener diode ZD is an example of the constant voltage discrimination element, and a characteristic feature is constituted in that the diode ZD is connected in parallel with the resistance R. Zener voltage Vz of the diode ZD is set to the minimum sustain voltage Vsm1–Vs or higher. When the transistor FET is turned ON based on a gate control signal, a current is applied to the resistance R and the Zener diode ZD.

Further, when the potential of the Yi electrode is at the Zener voltage Vz or higher, a current is applied abruptly since there is no component to limit the current. When the voltage applied across other ends of the diode ZD falls to the Zener voltage VZ or lower, the current stops to flow in the diode ZD.

Figure 17:
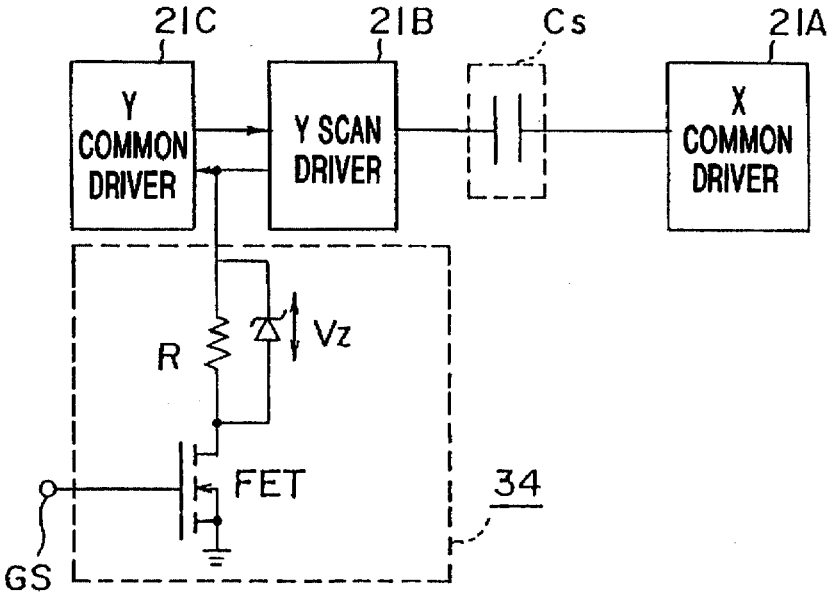
FIG. 17 is a block diagram of a control circuit according to the second preferred embodiment of the present invention.

Thus, according to a controller of plasma display related to the second embodiment of the present invention, the Zener diode ZD is provided in the waveform controller 34, and the diode ZD is connected in parallel with the resistance R as shown in FIG. 17.

Therefore, it is possible to control the discharge waveform of the erasing pulse at the time of complete write of the PDP 25 before selecting the address electrode Aj and after termination thereof very finely by the waveform controller 34.

For example, the complete write pulse Vw is applied to the X and Yi electrodes from the X common driver 21A and the Y scan driver 21B in a similar manner as the first embodiment of the present invention, which is a pre-operation of address discharge. At this time, the transistor FET is turned OFF, and further, the transistor FET is shifted to ON operation when complete write operation and the following sustained discharge operation are terminated.

Figure 18A:
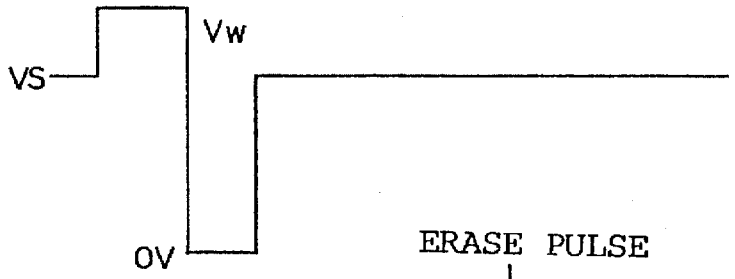
FIGS. 18A through 18C show operation waveform diagrams of the waveform shaping portion of the control circuit shown in FIG. 17.
Figure 18B:
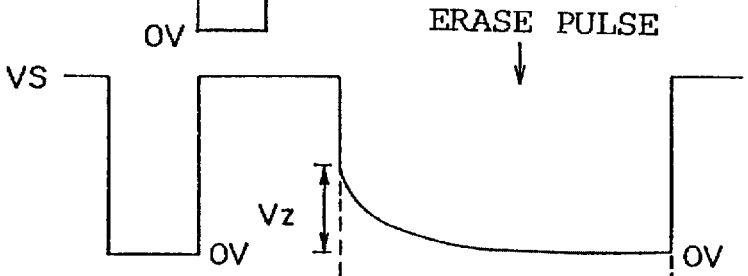
Figure 18C:
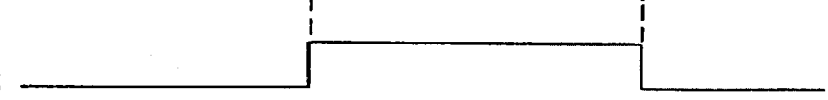
Figures 19A, 19B, 19C, 19D:
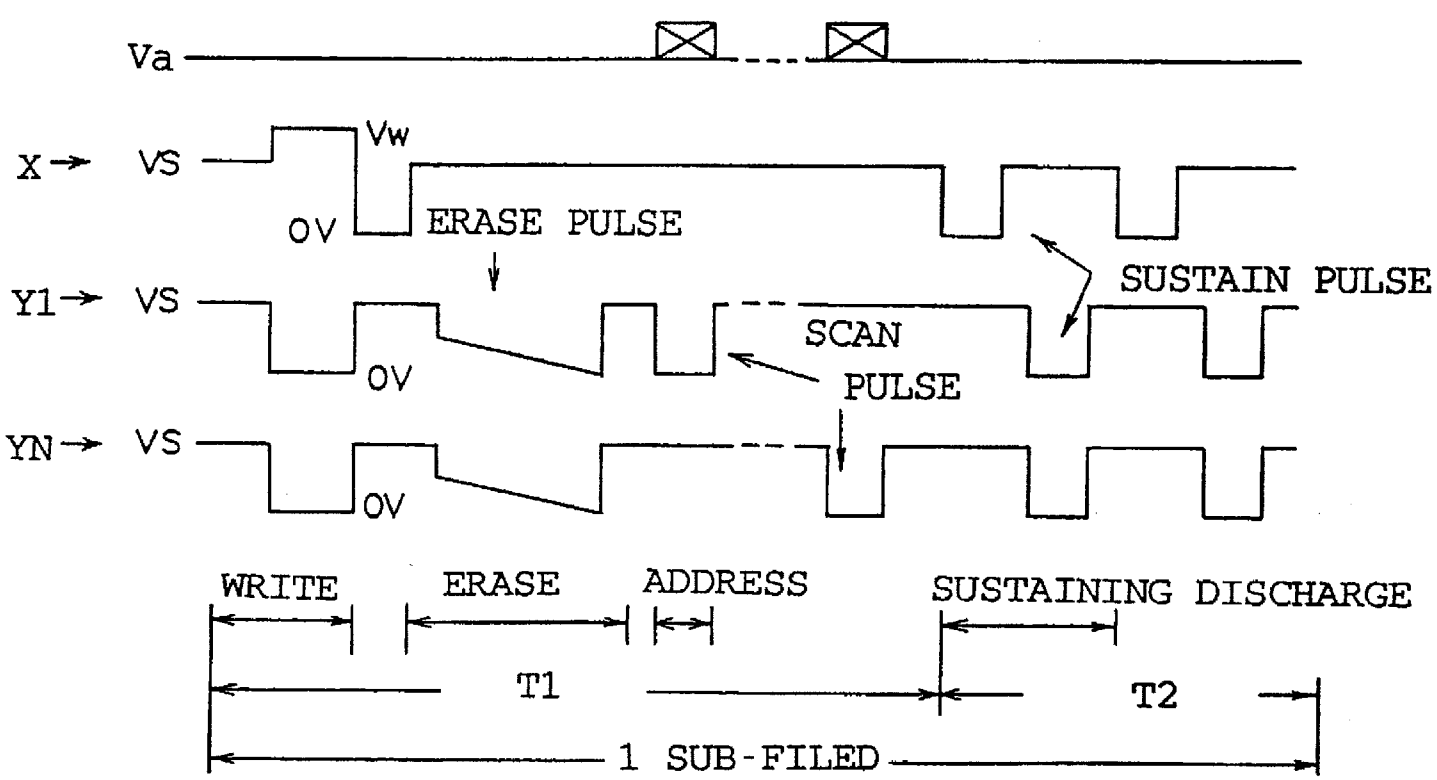
FIGS. 19A through 19D show waveform diagrams for explaining a control method according to the second preferred embodiment of the present invention.
Figures 22A, 22B, 22C, 22D:
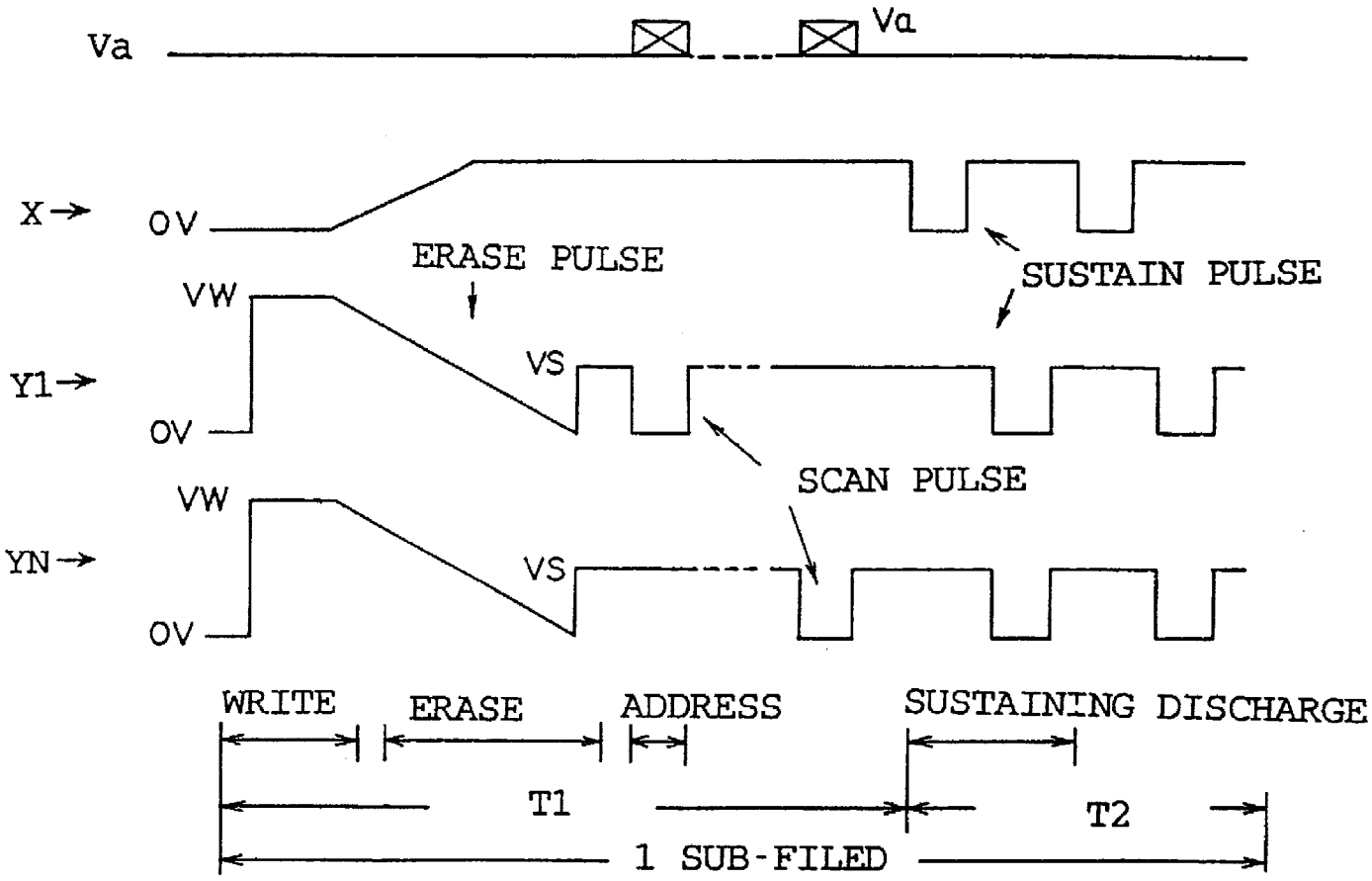
FIGS. 22A through 22D show waveform diagrams for explaining a control method according to a third preferred embodiment of the present invention.

Thus, as shown in FIGS. 18A through 18C, the transistor FET is turned ON based on a gate control signal GS, thereby to apply a current to the resistance R and the Zener diode ZD at the time of the complete erasing operation. In this case, the current flows abruptly because there is no component to limit the current in the state that the voltage of the Yi electrode is at the Zener voltage of the diode ZD or higher. When the voltage in the interim falls below the Zener voltage, the current no longer becomes applied to the diode ZD. Thereafter, the electric charges on the X and Yi electrodes are discharged with a circuit time constant based on the display cell Cs and the resistance R.

With this, it becomes possible to obtain an erasing pulse which changes in the waveform steeply at the initial stage of erasing and shows a large change in the gradient thereafter, and it becomes possible to have wall electric charges effective for address discharge remain on the X and Yi electrodes even when dispersion of the discharge starting voltage is produced in each display cell Cs.

Next, a method of controlling a plasma display according to the second embodiment of the present invention will be described while supplementing the operation of the controller concerned. The basic operation is similar to that of the first embodiment, and the point of difference thereof is to control the erasing pulse gently by the waveform controller 34.

Namely, in FIGS. 19A through 19D, a write pulse having voltage Vw is applied to the X electrode and write is executed over the whole cells similarly to the first embodiment. With this, positive electric charges (ions) are accumulated on the address electrode Aj as shown in FIG. 16A. Thereafter, a sustain pulse having voltage Vs is applied, thus performing sustained discharge. Then, the erasing pulse is applied so as to conduct erasing.

At this time, an erasing pulse, which has a polarity the same as that of the scan pulse for selecting the Yi electrode and is increased up to a value which does not exceed the maximum sustain voltage, is applied between the X and Yi electrodes during several microseconds to several hundred microseconds. Further, as shown in FIGS. 20A and 20B, voltage is applied steeply by the waveform controller 34 until immediately before the minimum sustained voltage Vsm1, which is the sustain voltage of the display cell Cs having the lowest voltage among the display panels 15, is reached.

The mechanism of erasing discharge is similar to that of the first embodiment, but it becomes possible to make the gradient of the erasing pulse more gentle when the same erasing period is set. With this, it becomes possible to have more wall electric charges remain behind and to conduct address discharge at a still lower voltage as compared with the first embodiment.

Here, the influence exerted by the gradient of the pulse on the formation of wall electric charges will be described with reference to FIG. 20. In a discharge phenomenon in gas, space charges such as electrons and ions move in the gap at a comparatively low speed. It has been known that there is a delay to some extent from a voltage application state to a discharge starting state.

This period of time is called a discharge delay time. In the typical PDP 25, the discharge delay time is normally from hundred ns to several μs, which, however, is different depending on conditions such as the applied voltage and filler gas. When it is assumed that the discharge delay time is Td, the discharge starting voltage is exceeded in a pulse rising process in case the rising time Tr of the applied voltage shows Tr<Td. Since there is the discharge delay time Td, however, discharge occurs at the peak voltage.

On the other hand, discharge is generated at a lower level than the peak voltage when Tr>Td. In this case, the formed quantity of wall electric charges becomes less than that when discharge occurs at the peak voltage. Accordingly, when Tr>>Td, the wall electric charges participating in discharge are reduced in quantity and the space charges and the wall electric charges formed by discharge are also reduced in quantity, and the residual wall electric charges are increased as a result of the above.

For example, as shown in FIGS. 20A and 20B, when it is assumed that the time when the PDP 25 reaches the discharge starting time and discharge is conducted in Td, the voltage after Td is lower in the second embodiment (2) as compared with the first embodiment (1). It can be said that the quantity of the residual wall electric charges is more in the case of (2).

Besides, the axis of ordinates in FIG. 21 shows an absolute value of an electric charge quantity Q, and the axis of abscissas shows the gradient dv/dt of the erasing pulse. The gradient dv/dt is the rate of voltage variation portion against the time variation portion.

An area B where the pulse acts as an erasing pulse is an area where the pulse falls short of the discharge starting voltage as shown in FIG. 21. This discharge starting voltage is the sum of voltage Vwr due to the remaining or generated wall electric charges and the voltage of the sustain pulse at a point of time when discharge is terminated completely.

Besides, since the scale of discharge is small and generated space charges are small in quantity in an area A, the neutralized quantity of the wall electric charges by space charges is also reduced and the quantity of the wall electric charges remaining finally is increased in this area. The wall electric charges in this case have the same polarity as the state before the pulse is applied.

Further, the operation of the pulse is almost equivalent to the operation of the sustain pulse in an area C. Here, the space charges generated in a large quantity neutralize the wall electric charges non-participating in discharge, and are attracted further by the applied voltage and accumulated as the wall electric charges. Thus, the polarity becomes different from that in a state before the pulse is applied.

With this, the closer access is made to the area A side, the more the minus wall electric charges are increased on the Yi electrode side in the area B, thus making it possible to conduct address discharge at a low applied voltage Va. On the contrary, as approaching the area C side, wall electric charges of a reverse polarity, which is plus, are accumulated on the Yi electrode side. As a result, high applied voltage becomes necessary with respect to address discharge.

Thus, according to a control method related to the second embodiment of the present invention, an erasing pulse is applied rapidly during several nanoseconds to several microseconds up to immediately before the smallest value of the minimum sustain voltage of the display cells Cs in the PDP 25 by the waveform controller 34, and thereafter, an erasing pulse is applied gently at a rate of several nanoseconds to several microseconds per unit voltage when the discharge waveform between the X and Yi electrodes is controlled.

As a result, even when dispersion of the discharge starting voltage is produced in each display cell Cs, the waveform falls steeply at the initial stage of erasing. Thereafter, it is possible to have wall electric charges effective for address discharge remain on the X and Yi electrodes by an erasing pulse showing a large gradient change. Namely, the wall electric charges participating in discharge are smaller in quantity in the second embodiment (2) as compared with the first embodiment (1) as shown in FIG. 20. As a result, it becomes possible to have a large quantity of wall electric charges, acting effectively on address discharge, remain after the space charges are neutralized.

With this, even if there is dispersion to some extent in the discharge starting voltage in each display cell Cs, it possible to have a large quantity of wall electric charges remain in a limited period of time, and it becomes possible to perform low voltage address discharge without running into a self-erasing operation as experienced in the related art of the present invention. This fact makes it possible to avoid a write mistake and makes for an excellent picture image display.

(3) Description of the Third Preferred Embodiment

Being different from the second embodiment, a complete write pulse (voltage Vw) is applied to Y1 electrode to YN electrode, a complete write discharge is executed, and thereafter, an erasing discharge is performed without through sustained discharge in a third embodiment.

Namely, when the normal complete write pulse is removed, either the potential difference between the X electrode and the Y1 electrode is made OV steeply, or a sustain pulse of a reverse polarity is applied immediately. In the case that too large a quantity of wall electric charges are formed by the complete write discharge, there is a method of making the potential difference between the X electrode and the Y1 electrode OV. However, discharge is generated by the wall electric charges only, and the self-erasing operation, in which wall electric charges sufficient for shifting to sustained discharge are lost, is started sometimes.

In this case, the control thereafter becomes impossible. Further, when a sustained discharge pulse of a reverse polarity is applied immediately after the complete write pulse is applied, there is such a possibility that discharge is started in the pulse application process (at the voltage rising time), thus making it impossible to perform normal sustained discharge.

In the third embodiment, as shown in FIGS. 22A through 22D, write discharge is performed for display cells in the whole plane by a complete write pulse having voltage Vw≧Vf applied from the Y1 electrode, and thereafter, voltage is applied while putting many hours in it so that the potential difference between the X electrode and the Y1 electrode shows OV while keeping the potential state as it is. Besides, Vf represents the discharge starting voltage between the X and Y1 electrodes.

Next, a pulse in which the potential difference has a polarity reverse to that of the voltage Vw and the potential difference shows Vs is applied. Here, when a large quantity of wall electric charges are generated by the complete write discharge in the process from the initial potential difference Vw to OV, discharge is performed with excessive electric charges so as to neutralize the electric charges. In other words, when it is assumed that the wall electric charges generated by complete write discharge is Vww, the voltage Vc applied between the X electrode and the Y1 electrode in a state that the voltage Vw is applied is expressed as Vc=Vw−Vww when Vww≧Vf.

Further, Vc<<Vf in a state that discharge is terminated, and Vc approaches Vc=Vww as the potential difference approaches OV. Since Vww≧Vf here, discharge occurs at the voltage Vww by the wall electric charges only.

Although Vww has a value larger than Vf, it does not become high in particular. Thus, the wall electric charges (in Vww) participating in discharge become less. With this, excessive electric charges are neutralized and lost. As a result, even when high Vw is applied and too large an amount of wall electric charges are generated, the wall electric charge quantity immediately before the erasing discharge is started is sustained almost constant because the wall electric charges are removed in the process, described above.

Figure 23A:
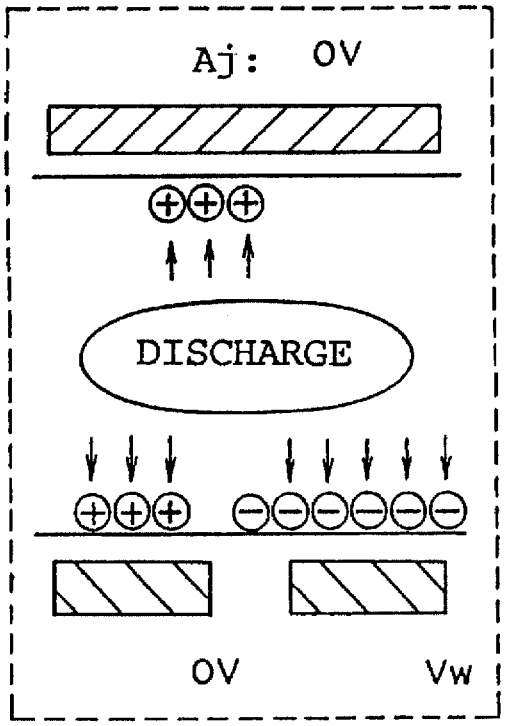
FIG. 23A to FIG. 23C are diagrams for supplementarily explaining a control method according to the third preferred embodiment of the present invention.
Figure 23B:
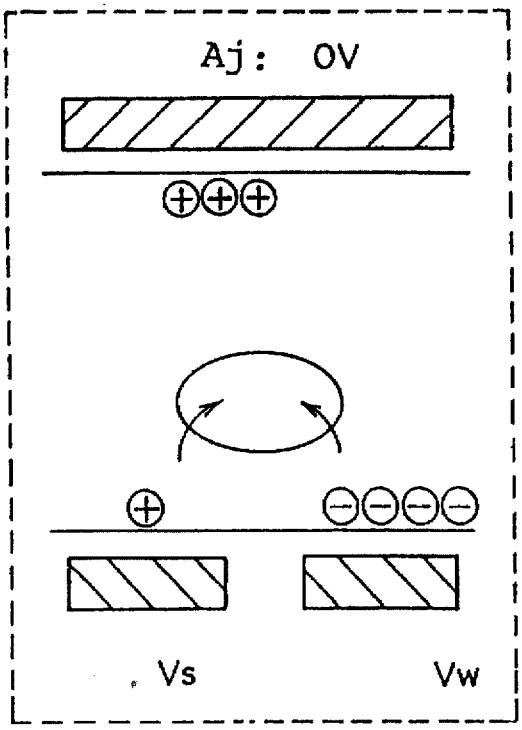
Figure 23C:
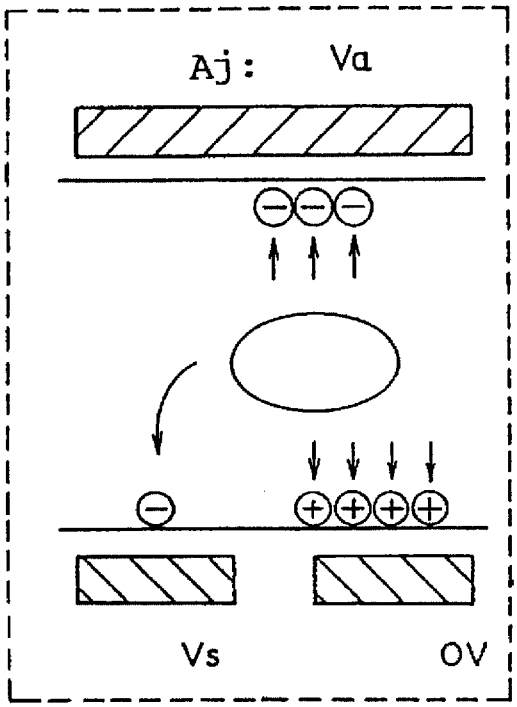

In the next step, the potential difference between the X electrode and the Y1 electrode becomes from OV to Vs. Therefore, it is possible to perform an erasing discharge similar to that in the first and the second embodiments as shown in FIG. 23B. Besides, selective write (address discharge) of the display cell Cs is executed similarly to the first embodiment, and the sustained pulse is applied alternately to the X electrode and the Yi electrode over the whole picture plane after the address discharge is performed in all the display lines, thus repeating the sustained discharge. With this, it is possible to control the PDP 25 similarly to the first embodiment.

In such a manner, according to a control method related to the third embodiment of the present invention, the write pulse Vw exceeding the discharge starting voltage Vf is applied to one of the X and Yi electrodes in the complete write operation of the PDP 25, then the potential difference between the X and Yi electrodes is made OV from the potential state at the time of termination of the complete write operation, and in succession, control is made of the discharge waveform between the X and Yi electrodes applied with the erasing pulse having the polarity of the write pulse Vw at the time of complete write operation up to a value which does not exceed the maximum sustain voltage.

Thus, being different from the first and the second embodiments, it becomes possible to perform the erasing discharge for having an almost constant wall electric charge quantity on the X and Yi electrodes without through sustained discharge after the complete write pulse is applied between the X and Yi electrodes and the complete write discharge is executed.

With this, it becomes possible to make the residual wall electric charges constant in quantity before the address discharge even when too large a quantity of wall electric charges are generated on the X and Yi electrodes by the complete write operation. Thus, it becomes possible to avoid a write mistake and make for an excellent picture image display.

What is claimed is:

1. A method of controlling a plasma display which has a plurality of display cells defined by a plurality of electrode pairs disposed between a first panel and a second panel facing each other, and having a gas enclosed between the first and second panels, each of said plurality of display cells having first and second electrodes, wherein the gas causes a discharge by applying a voltage across corresponding ones of the first and the second electrodes, said method comprising the steps of:

applying an erase signal to one of said plurality of display cells to control an amount of wall charges accumulated in the one display cell, wherein a voltage of said erase signal is varied with time;

effecting an addressing discharge to select the one display cell by superimposing an address voltage over the wall charges, after applying the erase signal to the one of said plurality of display cells; and conducting a sustain discharge for display by causing a discharge on the selected one display cell, after effecting the addressing discharge to select the one display cell.

2. A plasma display device, comprising:

a display panel for holding a discharge gas between first and second insulator substrates, the display panel having a plurality of display cells defined by pairs of first and second electrodes parallely disposed relative to each other on the first insulator substrate and a plurality of third electrodes disposed on the second insulator substrate and intersecting the first and second electrodes of respective said pairs; and a control circuit for controlling a discharge of each of said plurality of display cells, said control circuit further comprising a first driver to apply a write pulse and a sustain pulse across the first and the second electrodes of one of said plurality of display cells to cause a writing discharge and a sustaining discharge on the discharge gas, the writing discharge producing wall charges on said first and second insulator substrates, a discharge circuit to control an amount of the wall charges accumulated on said first insulator substrate, a switching element to control a discharge timing of said discharge circuit, and a second driver to apply an address pulse to the third electrode of the one display cell, said address pulse being superimposed over a voltage produced by said wall charges accumulated on said first and second insulator substrates to form a writing voltage;

wherein said switching element drives said discharge circuit at a timing after said write and sustain pulses have been applied to the one display cell and before said address pulse is applied to the one display cell, to control the amount of wall charges accumulated on said first insulator substrate.

3. The plasma display device according to claim 2, wherein said discharge circuit comprises a resistor element having one end connected between said first driver and the first insulator substrate and a second end connected to a ground potential through said switching circuit.

4. The plasma display device according to claim 3, wherein said discharge circuit further comprises a constant voltage discrimination element connect in parallel with said resistor element, to regulate a current flowing through said resistor element.

5. The plasma display device according to claim 4, wherein said constant voltage discrimination element is a zener diode.

6. A method of controlling a plasma display device which has a display panel for holding a discharge gas between first and second insulator substrates, the display panel having a plurality of display cells defined by pairs of first and second electrodes parallely disposed relative to each other on the first insulator substrate and a plurality of third electrodes disposed on the second insulator substrate and intersecting the first and second electrodes of respective said pairs, said control circuit for controlling a discharge of each of said plurality of display cells, said control method comprising the steps of:

applying a write pulse across the first and second electrodes of one of said plurality of display cells to cause a writing discharge of said discharge gas and to accumulate wall charges on said first and second insulator substrates;

applying an erase pulse across the first and second electrodes of the one display cell, subsequent to said write pulse applying step, to regulate an amount of the wall charges accumulated on said first insulator substrate so as to leave a given amount of the wall charges which will cause an addressing discharge when an address pulse is applied across either one of the first and second electrode, and third electrodes of the one display cell, wherein a voltage value of said erase pulse is changed with time;

applying said address pulse across either one of the first and second electrode, and third electrodes of the one display cell to cause the addressing discharge on the one display cell subsequent to said erase pulse applying step; and applying a sustain pulse across the first and second electrodes of the one display cell to cause a sustaining charge on the one display cell, subsequent to said address pulse applying step.

7. The method according to claim 6, wherein said sustain pulse has an opposite polarity from that of said write pulse, and said applying step is performed between said write pulse applying step and said erase pulse applying step.

8. The control method according to claim 6, wherein said erase pulse has a same polarity as that of the write pulse and increases in voltage from 0 volts to a maximum value within a time interval between several microseconds and several hundred microseconds.

9. The control method according to claim 8, further comprising a step of applying a sustain pulse across the first and second electrodes of the one display cell to cause a sustaining discharge of said discharge gas, said sustain pulse having an opposite polarity from that of said write pulse, wherein said applying step is performed between said write pulse applying step and said erase pulse applying step and said maximum value of said erase pulse is a same value as an absolute value of a voltage of said sustain pulse.

10. The control method according to claim 6, wherein said erase pulse applying step comprises varying said erase pulse in voltage from 0 volts to a maximum value at a uniform rate with respect to time.

11. The control method according to claim 6, wherein said erase pulse applying step comprises varying said erase pulse in voltage from 0 volts to a maximum value nonlinearly with respect to time.

12. The control method according to claim 6, wherein said erase pulse applying step comprises increasing said erase pulse quickly in magnitude within several nanoseconds to several microseconds up to approximately a minimum value for keeping a sustaining discharge on the one display cell, and thereafter, increasing said erase pulse in magnitude at a constant rate for several hundred nanoseconds to several microseconds.

13. The control method according to claim 6, wherein said erase pulse applying step comprises increasing said erase pulse quickly in magnitude within several nanoseconds to several microseconds up to approximately a minimum value for keeping a sustaining discharge on the one display cell, and thereafter increasing said erase pulse in magnitude nonlinearly up to approximately a maximum value for keeping the sustaining discharge.

* * * * *

UNITED STATES PATENT AND TRADEMARK OFFICE

CERTIFICATE OF CORRECTION

PATENT NO. : 5,663,741

DATED : September 2, 1997

INVENTOR(S) : Kanazawa

It is certified that error appears in the above-identified patent and that said Letters Patent is hereby corrected as shown below:

ON THE TITLE PAGE:

Item [63], "1994" should be --1994--.

Signed and Sealed this

Twenty-ninth Day of September, 1998

*Attest:*

Bruce Lehman

BRUCE LEHMAN

*Attesting Officer*

*Commissioner of Patents and Trademarks*